US009003856B2

(12) United States Patent
Masuyama

(10) Patent No.: US 9,003,856 B2
(45) Date of Patent: Apr. 14, 2015

(54) METHOD OF MANUFACTURING FLANGE STRUCTURE

(75) Inventor: Takehiko Masuyama, Nagoya (JP)

(73) Assignee: Matec Co., Ltd., Aichi (JP)

( * ) Notice: Subject to any disclaimer, the term of this patent is extended or adjusted under 35 U.S.C. 154(b) by 347 days.

(21) Appl. No.: 13/606,454

(22) Filed: Sep. 7, 2012

(65) Prior Publication Data

US 2014/0069161 A1 Mar. 13, 2014

(51) Int. Cl.
*B21K 23/04* (2006.01)

(52) U.S. Cl.
CPC ..... *B21K 23/04* (2013.01)

(58) Field of Classification Search
CPC ..... B21K 1/28; B21K 1/40; B21K 23/04; B21D 53/88; B60B 27/00; F16C 2326/02
USPC ..... 72/352, 353.2, 356, 273, 276; 29/897.2
See application file for complete search history.

(56) References Cited

U.S. PATENT DOCUMENTS 5,127,253 A * 7/1992 Takahara et al. ..... 72/356
7,000,444 B2 * 2/2006 Roeske et al. ..... 72/354.2
7,350,391 B2 * 4/2008 Takagi ..... 72/356
7,827,842 B2 * 11/2010 Hase et al. ..... 72/342.2
2009/0106980 A1 * 4/2009 Hirai et al. ..... 29/898.04

FOREIGN PATENT DOCUMENTS

| | | |
|---|---|---|
| CA | 2086302 | 6/1994 |
| JP | 60-244428 | 12/1985 |
| JP | 06-229410 | 8/1994 |
| JP | 2011-161447 | 8/2011 |
| JP | 4920756 | 4/2012 |

* cited by examiner

*Primary Examiner* — Teresa M Ekiert
(74) *Attorney, Agent, or Firm* — Wenderoth, Lind & Ponack, L.L.P.

(57) ABSTRACT

A method of manufacturing a flange structure includes: forming a primary product by extending a columnar material in an axial direction by cold or warm forging such that first shaft portion and a second shaft portion are formed at a first axial end of the material and a second axial end of the material, respectively; forming a secondary product by making a middle portion of the primary product overhang outwardly by cold or warm forging such that a first overhang having a thickness greater than that of the flange is formed; forming a tertiary product by squeezing the first overhang by cold or warm forging such that a second overhang having an outline greater than that of the flange is formed; and defining an outer edge of the flange by cutting off an excessive portion of the second overhang. The second overhang without the excessive portion is the flange.

4 Claims, 26 Drawing Sheets

METHOD OF MANUFACTURING FLANGE STRUCTURE

BACKGROUND

1. Technical Field

The present invention relates to a method of manufacturing a flange structure.

2. Description Of Related Art

Block anchors for use in parking brakes for vehicles, for instance, have flanges that greatly and elliptically overhang outward from outer circumferences of shafts. In manufacturing such component, the flange is often formed by hot forging because material is greatly deformed.

However, hot forging is disadvantageous, in that: the cost is increased (as hot forging requires a large-sized device); a manufacturing rate is low; skill and experience are required; additional processes such as cutting and grinding are required after forging for components requiring high dimension precision (as hot forging hardly results in final products with good surfaces); and the like.

Use of cold forging has been examined in all processes. However, such method is not practically applicable to a manufacturing of, for instance, a component that requires a greatly-overhanging flange because the pressure at the time of forming the component is excessively increased.

In addition, when the overhanging shape of the flange is non-circular (e.g., elliptic), the material is circularly overhung by swaging and subsequently subjected to cutting and burring to conform to the targeted shape of the flange. Thus, the material yield is reduced.

As one solution for the problem describe above, Japanese Patent No. 4920756 (hereinafter referred to as "Patent Document 1") discloses a method of manufacturing a flange structure including two forging steps of a first and a second forging steps. In the first forging step, a product with a thicker head than a flange of an anchor block is formed. Then, in the subsequent second forging step, the head of the product formed in the first forging step is squeezed by a die and a punch with at least a part of an outer circumference of the head free from a constraint by the die and the punch. The resulting product has a brim portion one size greater than the flange. Thereafter, an excessive portion that protrudes outward from the brim portion is punched into a profile of the flange.

By performing the forging in two steps as described above, the brim portion is formed to have a profile close to the final profile of the flange in the second forging step. Therefore, the excessive portion to be cut off is small, which contributes to improve the material yield. In addition, when the head is squeezed in the second forging step, a part of the lateral surface thereof is not constrained by the die. Therefore, the excessive material is forced out as bur from between the punch and the die. Therefore, a compression load required for the forming at each step is small, obtaining the flange with a great overhanging area without use of hot forging.

According to Patent Document 1 described above, the targeted anchor block to be manufactured is a single-shaft anchor block with a shaft portion only at a single side (i.e., the shape represented by solid line in FIG. 24). However, the anchor block G includes a dual-shaft structure with a shaft portion at both sides (i.e., the structure including, in addition to the shaft portion 7 represented by solid line, a shaft portion 3 represented by two-dot chain line in FIG. 24). When the dual-shaft anchor block G is manufactured according to the method disclosed in Patent Document 1, as illustrated in FIGS. 25 and 26, a punch P for use in the second forging step may preliminarily have a shaft forming hole 500. Then, in the second forging step, the head H of the product mounted on a die hole 510 of a die D may be squeezed with the punch P to form the brim portion I and the shaft portion 3 at the same time. However, according to Patent Document 1, in order to make the compression load at the time of forming small, a part of the lateral surface is not constrained by the die when the head H is squeezed. Thus, even when an attempt is made to squeeze the head H and to form the shaft portion 3 at the same time, most of the material may flow outward, and thus the shaft portion 3 will be difficult to be formed.

SUMMARY

In view of the background circumstances described above, the present invention provides a method through which a dual-shaft flange structure with a shaft portion at both sides of a flange that extends outward is efficiently manufacturable.

An aspect of the invention provides a method of manufacturing a flange structure including two shaft portions and a flange provided between the two shaft portions. The method including: forming a primary product by extending a columnar material in an axial direction by cold or warm forging such that each of the shaft portions is formed at each axial end of the material; forming a secondary product by making a middle portion of the primary product overhang outward by cold or warm forging such that a first overhang having a thickness greater than that of the flange is formed; forming a tertiary product by squeezing the first overhang by cold or warm forging such that a second overhang having an outline greater than that of the flange is formed; and defining an outer edge of the flange by cutting off an excessive portion of the second overhang. At least a part of an outer circumference of the first overhang is kept free from a constraint by a die and a punch while the second overhang is being formed. The excessive portion protrudes outward from the outline of the flange.

DETAILED DESCRIPTION

An exemplary embodiment according to the aspect of the invention will be described with reference to FIGS. 1 to 23.

Figure 1:
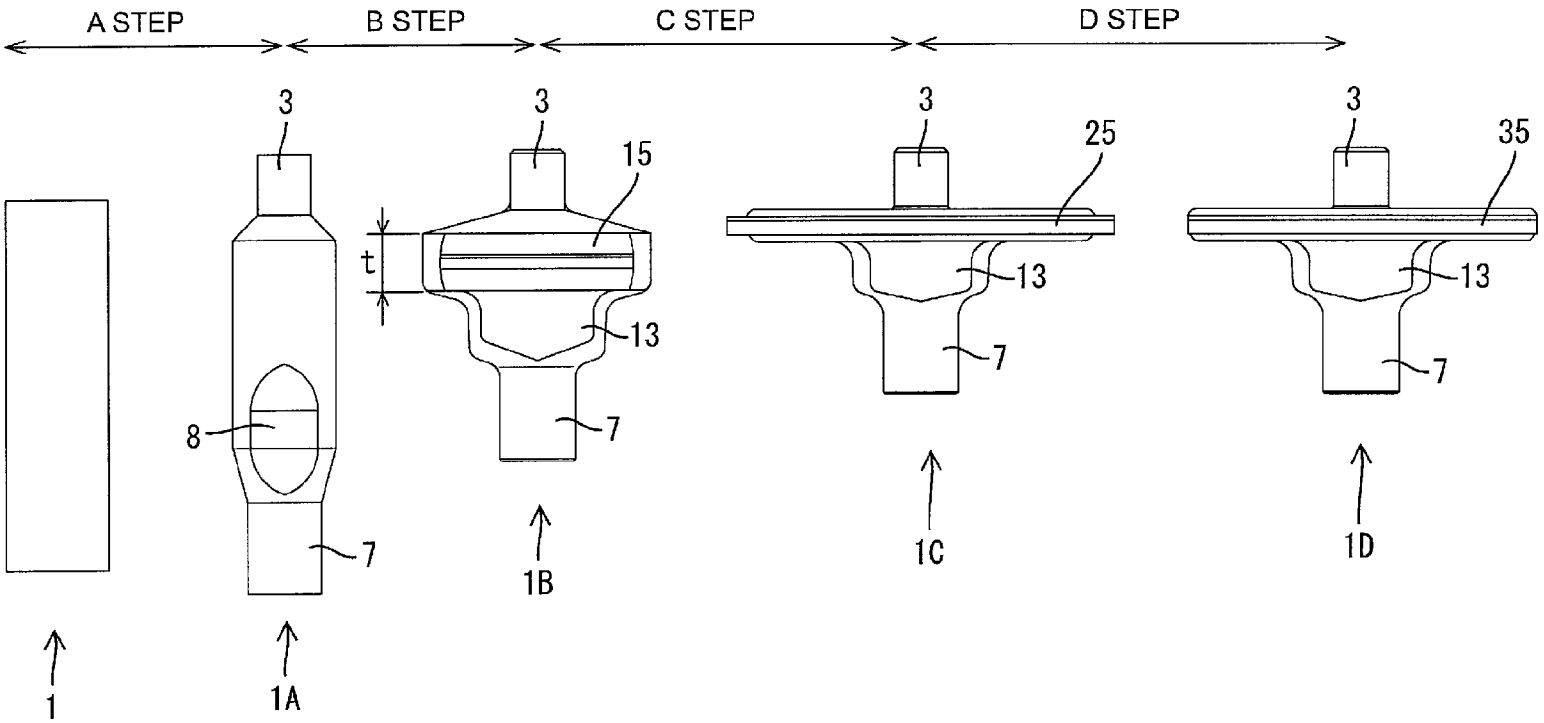
FIG. 1 illustrates a forming process for an anchor block according to an exemplary embodiment.

A flange structure to be manufactured according to this exemplary embodiment is an anchoring block 1D for use as a parking brake for vehicles (hereinafter referred to as "anchoring block 1D"). The anchoring block 1D includes a substantially elliptic flange 35 extending outward in the radial direction with shafts 3 and 7 respectively positioned at both sides of the flange 35. In this exemplary embodiment, a cylindrical material 1 illustrated in FIG. 1 is formed into the anchor block 1D through four steps A to D described as follows. The material 1 is exemplarily made of alloyed steel.

(1) In the Step A, the material 1 is formed into a primary product 1A with the shafts 3 and 7 at respective ends by cold or warm forging.

(2) In the Step B, the primary product 1A is formed into a secondary product 1B having a first overhang 15 thicker than the flange 35 by cold or warm forging.

(3) In the Step C, the secondary product 1B is formed into a tertiary product 1C having a second overhang 25 greater than the flange 35 by cold or warm forging.

(4) In the Step D, a profile of the flange 35 is formed by cutting off an excessive portion 27 of the second overhang 25. The excessive portion 27 protrudes outward from an outline of the flange 35.

In the "cold forging", the material 1 is subjected to compression forming at ambient temperature (room temperature), while in the "warm forging", the material 1 is heated (exemplarily to 550° C. to 800° C.) and subjected to compression forming.

Figure 2:
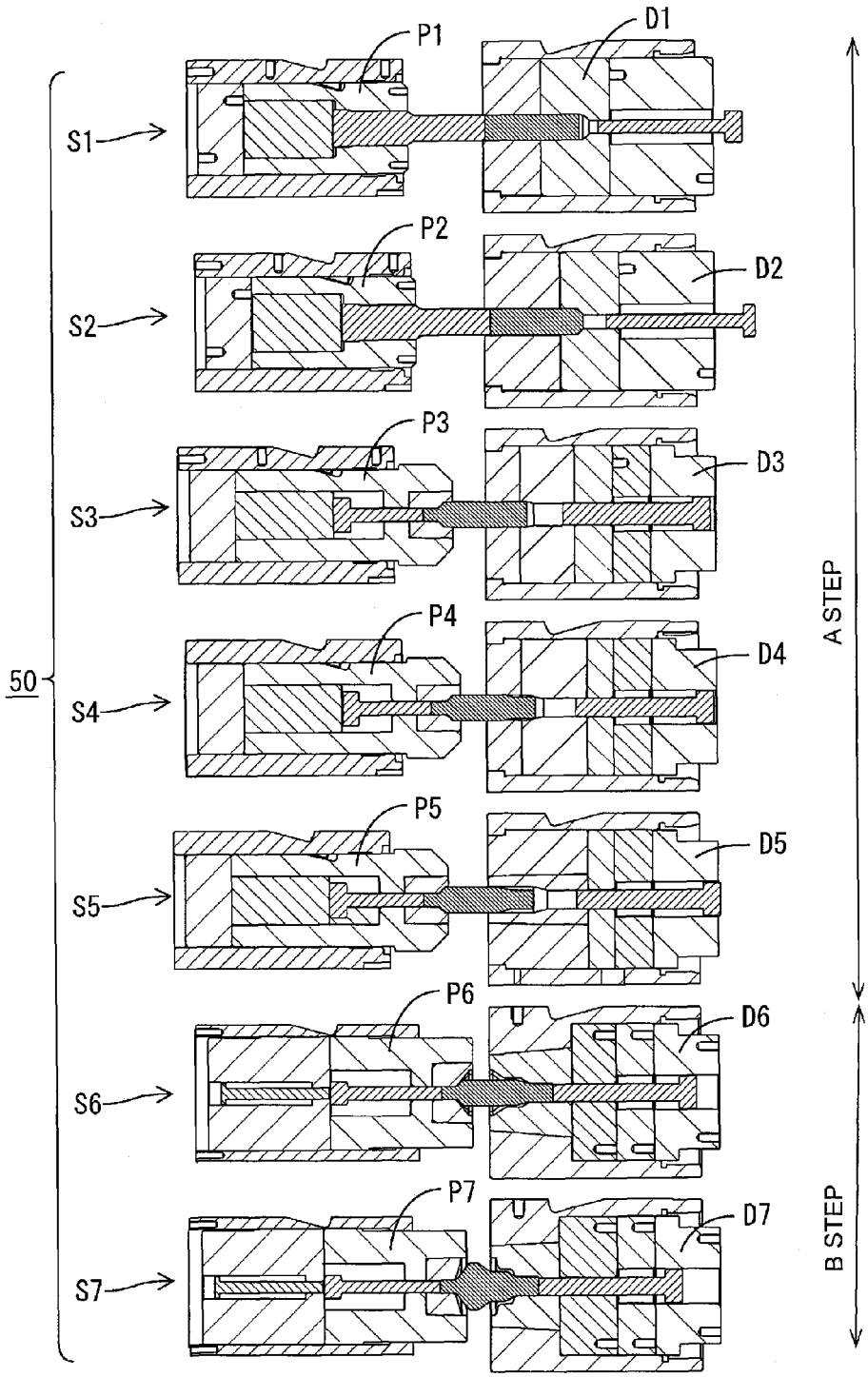
FIG. 2 is a lateral cross sectional view illustrating a structure of a multistage forging die device.

In the description below, steps A to D are described. In this exemplary embodiment, steps A and B are performed with use of a single multistage forging die device 50. As illustrated in FIG. 2, the multistage forging die device 50 includes seven pairs of die D and punch P, i.e., seven forming stages S1 to S7. The seven pairs of die D and punch P are adapted to be fastened to each other altogether at one time by a die closing device (not illustrated). The multistage forging die device 50 also includes a transporter 140 that transports the materials 1 to the respective forming stages S by pitch feed. In the multistage forging die device 50, the materials 1 are subjected to the forming at each of the forming stages S concurrently and transported by the transporter 140 to the subsequent forming stages S. In the following description, in the "die closing", the punches P are brought close to the dies D, while in the "die opening", the punches P are spaced apart from the dies D.

Figure 3:
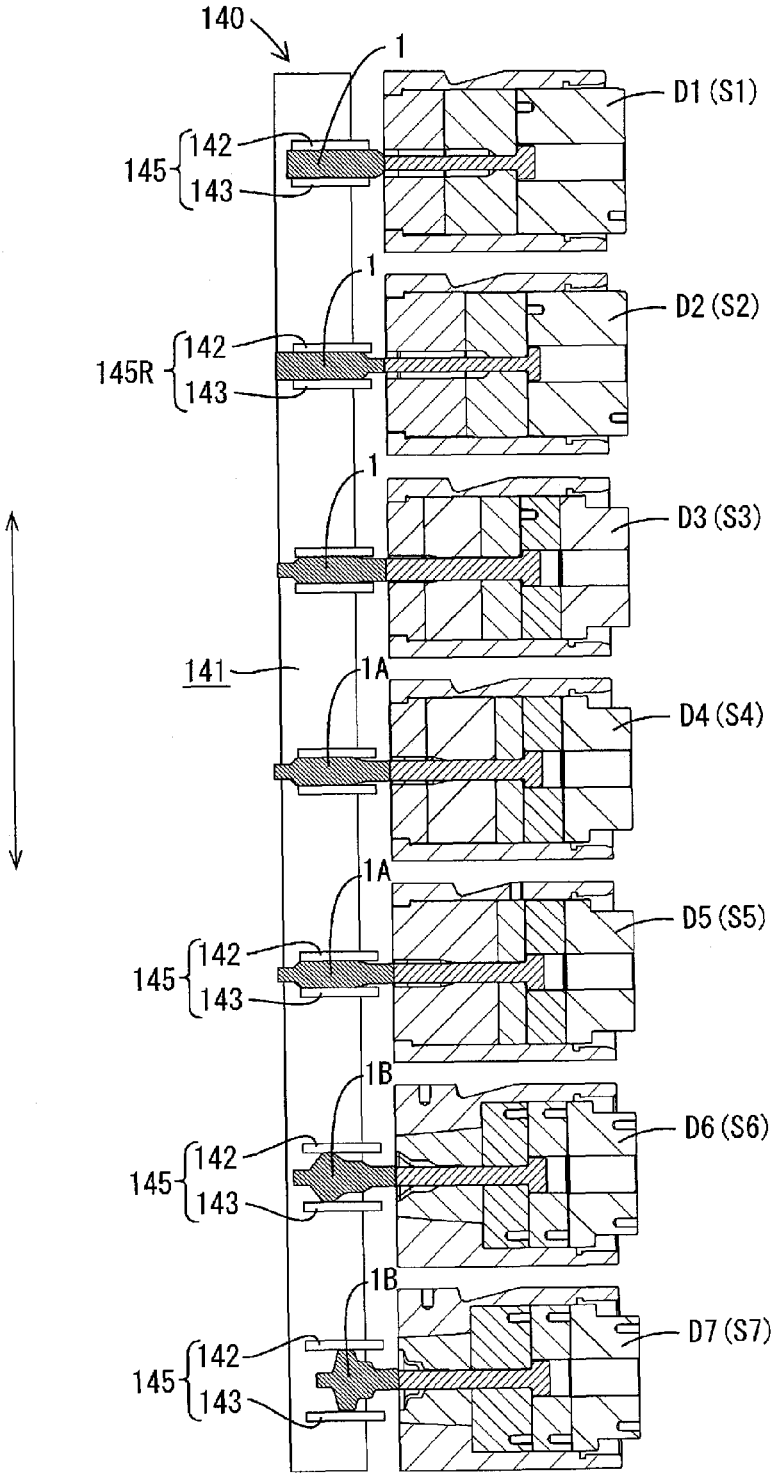
FIG. 3 is a lateral cross sectional view illustrating a structure of a transporter.

As illustrated in FIG. 3, the transporter 140 includes a movable plate 141 adapted to reciprocate in a direction in which the forming stages S1 to S7 are arranged (in an upper and lower direction in FIG. 3). The movable plate 141 includes seven holders 145, each of which includes a pair of claws 142 and 143. The holders 145, which are respectively positioned to correspond to the forming stages S1 to S7, are configured to hold the materials 1, the primary products 1A, or the secondary products 1B ejected from die holes of the dies D1 to D7. Thus, the materials 1, the primary products 1A, or the secondary products 1B ejected from the die holes are held by the holder 145 and then transported to the subsequent one of the forming stages S1 to S7 by the movable plate 142 moving in the upper and lower direction of FIG. 3. After the transportation is finished, the movable plate 141 returns to its original position and stands by for the next transportation.

Figure 4:
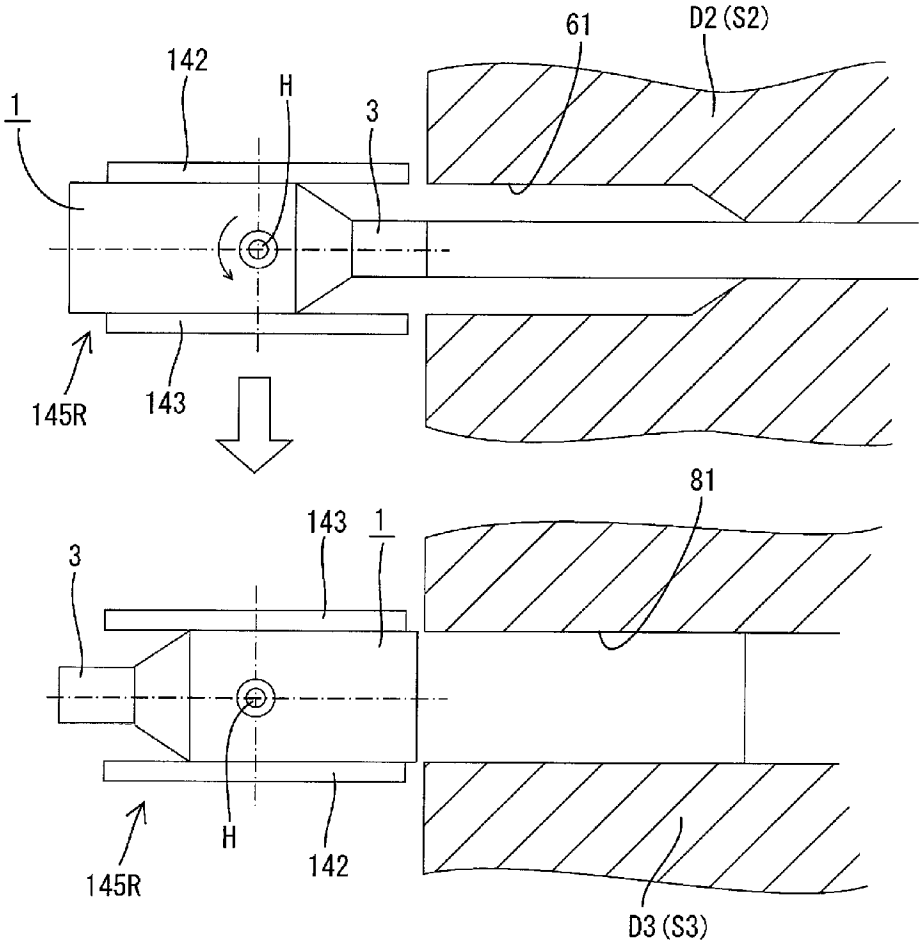
FIG. 4 illustrates an inversion operation of a material.

The second holder 145R on the movable plate 141 (i.e., the holder for use in transporting the material 1 from the second forming stage S2 to the third forming stage S3) is rotatable with respect to a hinge H in its entirety. When the material 1 is transported from the second forming stage S2 to the third forming stage S3, the holder 145R is rotated around the hinge H by 180 degrees to invert the orientation of the material 1 by 180 degrees (see, FIG. 4). Just for reference, FIG. 3 illustrates only the dies D and the transporter 140, and the punches Pare omitted. On the other hand, FIG. 4 illustrates only the dies D and the holder 145R, and the punches P and the movable plate 141 are omitted.

1. Step A: Forming of Primary Product 1A

Step A includes five processes performed respectively at the five forming stages S1 to S5.

<First and Second Forming Stages>

Figure 5:
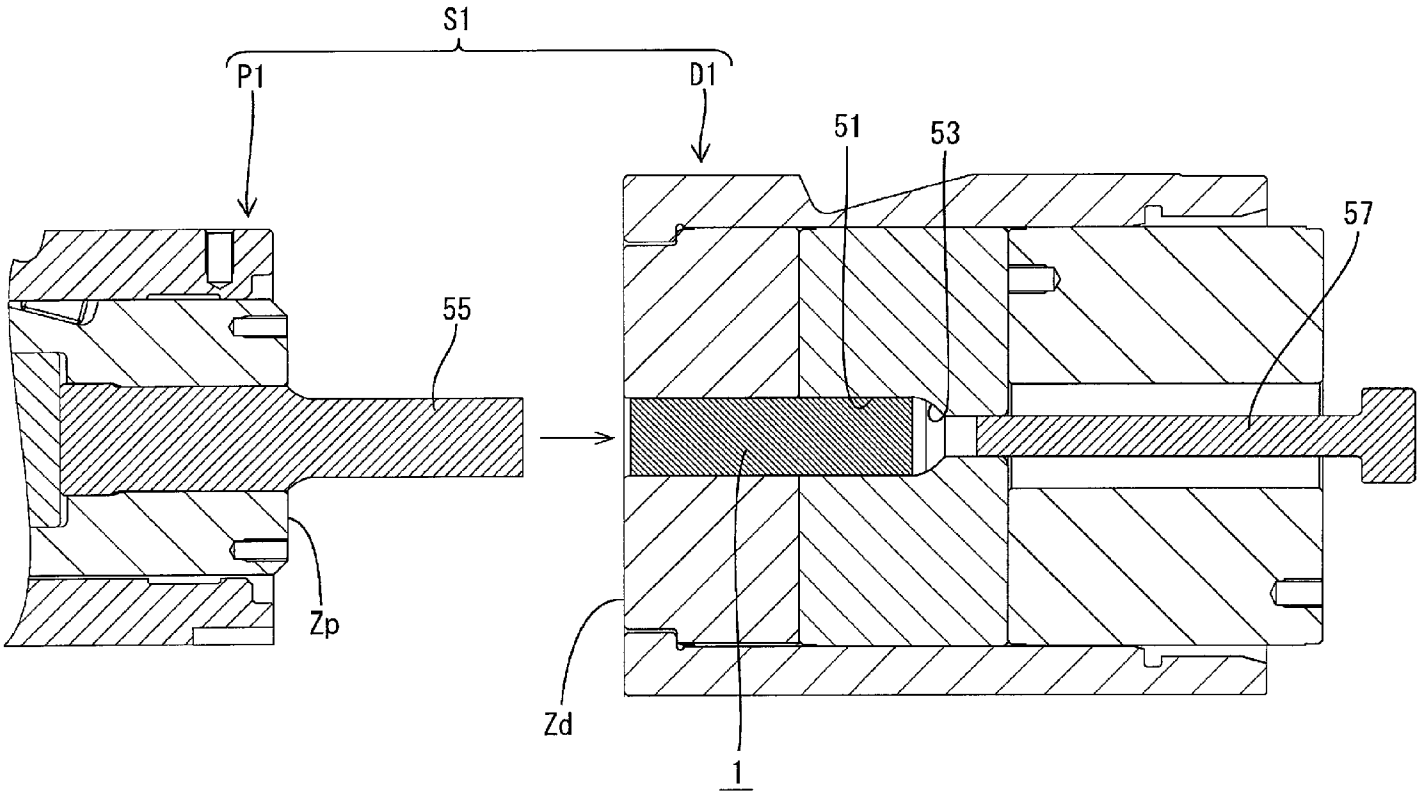
FIG. 5 is a lateral cross sectional view illustrating a punch and a die in a forming stage S1 in a die opening state.
Figure 6:
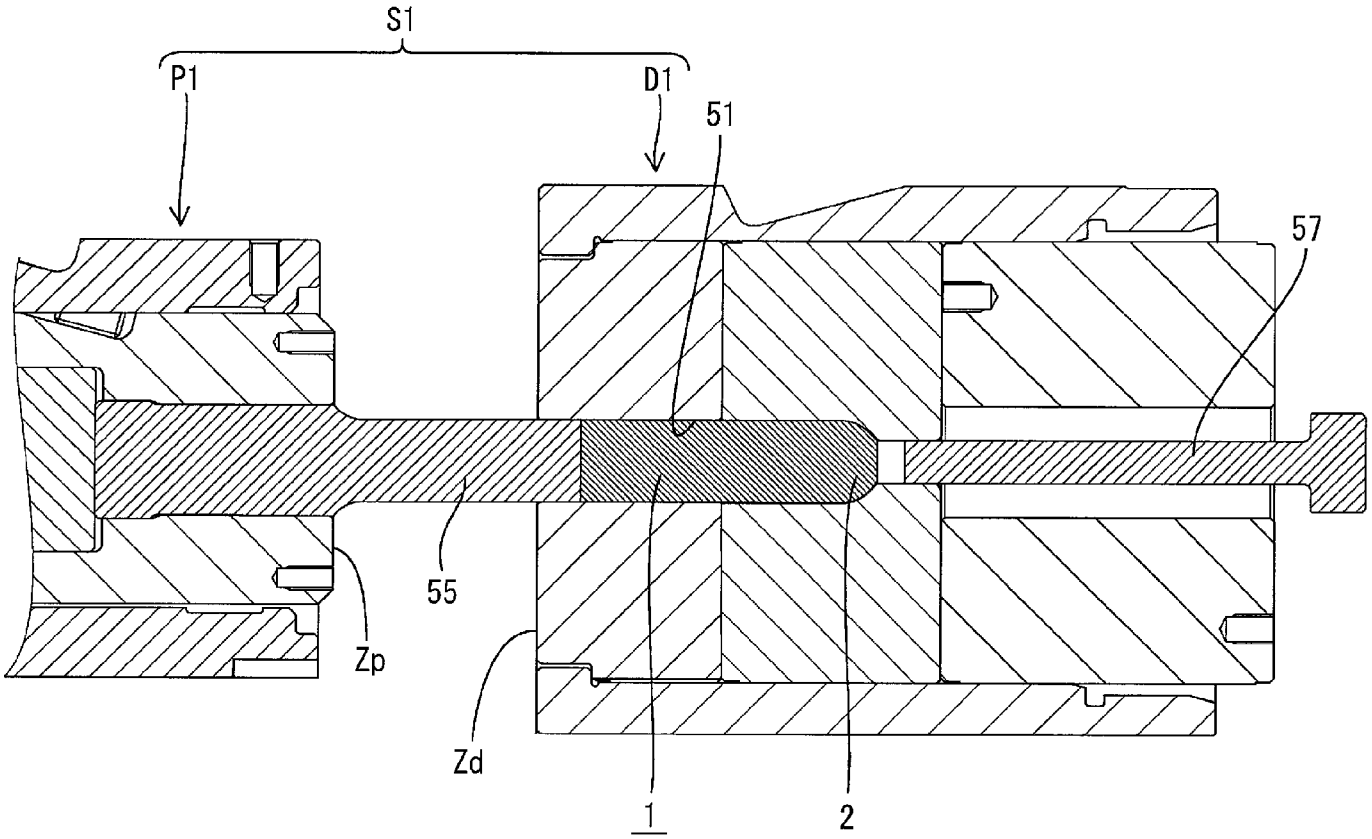
FIG. 6 is a lateral cross sectional view illustrating the punch and the die in the forming stage S1 in a die closing state.

The first die D1 in the first forming stage S1, which is a cylindrical die of metal, has a die hole 51 in a forming surface Zd (a surface facing the first punch P1) (see, FIG. 5). The die hole 51 is sufficiently sized to accept the material 1 from the front side. The depth of the die hole 51 is longer than the entire length of the material 1 to accommodate the entirety of the material 1. The die hole 51 has a taper forming portion 53 at the innermost side (right side in FIG. 5), which tapers toward the inside of the die D1 to have a conical surface shape.

The first punch P1 as paired with the first die D1, which is a cylindrical punch of metal, has a punch pin 55 attached at a forming surface Zp (a surface facing the first die D1). The punch pin 55 faces the die hole 51 to fit in the die hole 51 without space therebetween.

In the forming stage S1 described above, the punch pin 55 is pushed into the die hole 51 by die closing to push the material 1 to insert the end thereof in the die hole 51 toward the further inside of the die D1. Thus, the material 1 is deformed to fill the taper forming portion 53, providing a tapered portion 2 at a first end of the material 1 (a right end in FIG. 6) (see, FIG. 6). After the forming stage S1 is completed, the material 1 is ejected from the die hole 51 by a knock out pin 57 provided in the first die D1, and then held by the holder 145 that is standing by at an entrance of the die hole 51 to be transported by the transporter 140 to the subsequent forming stage S2.

Figure 7:
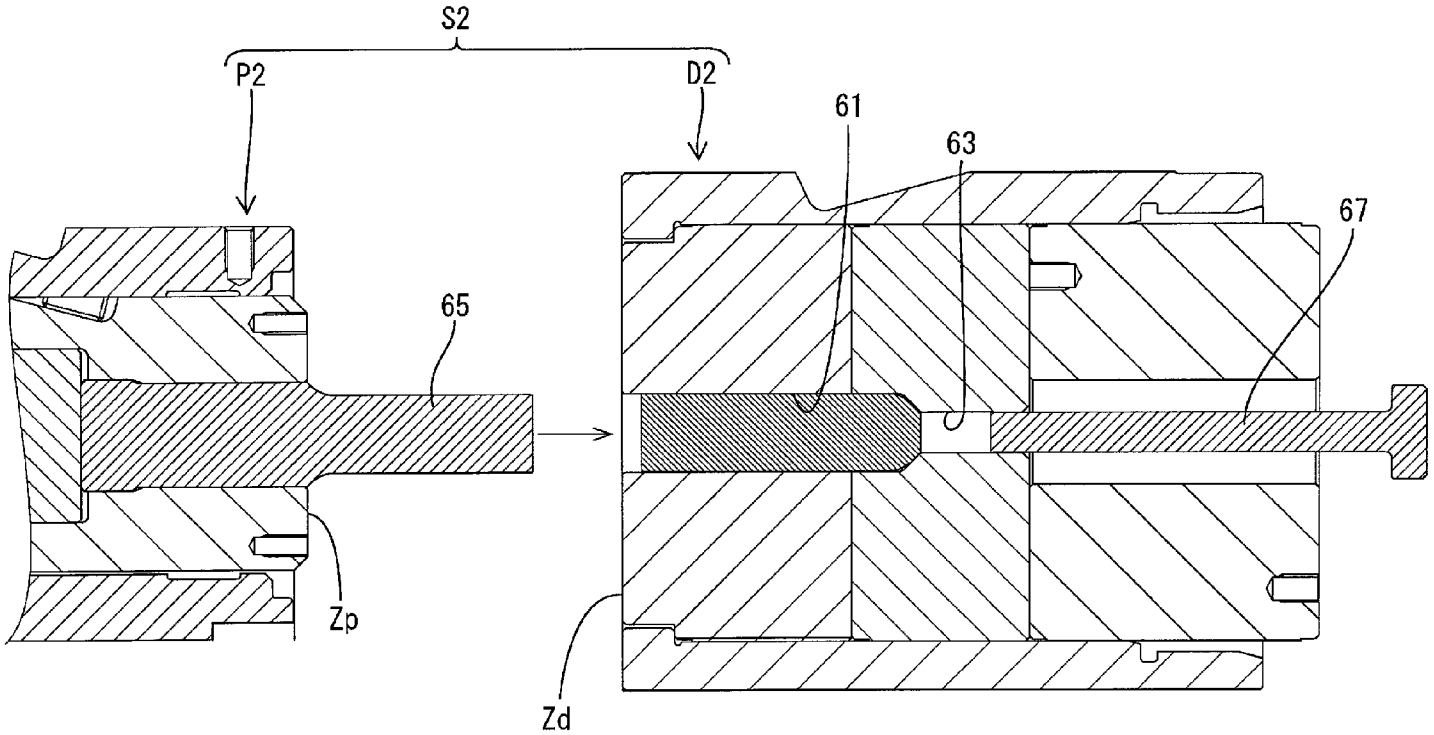
FIG. 7 is a lateral cross sectional view illustrating a punch and a die in a forming stage S2 in the die opening state.
Figure 8:
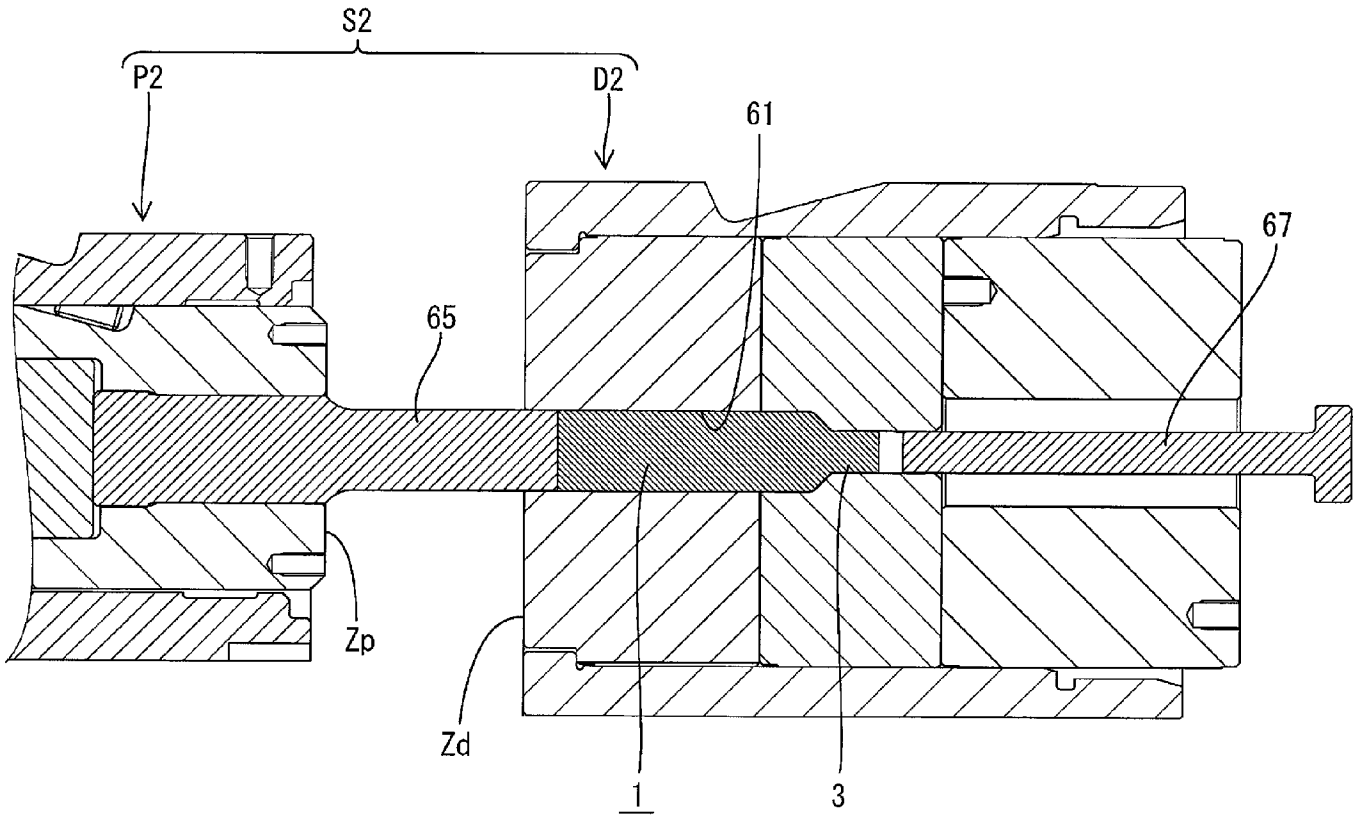
FIG. 8 is a lateral cross sectional view illustrating the punch and the die in the forming stage S2 in the die closing state.

The second die D2 in the second forming stage S2, which is a cylindrical die of metal, has a die hole 61 in a forming surface Zd (a surface facing the punch P2) (see, FIG. 7). The die hole 61 is sufficiently sized to accept the material 1 without space therebetween. The depth of the die hole 61 is longer than the entire length of the material 1 to the entirety of the material 1. The die D2 has a shaft hole 63 further inside than the die hole 61. The shaft hole 63 has a diameter smaller than that of the die hole 61 to form the shaft portion 3 at an end of the material 1.

The second punch P2 as paired with the second die D2, which is a cylindrical punch of metal, has a punch pin 65 attached at a forming surface Zp (a surface facing the second die D2). The punch pin 65 faces the die hole 61 to fit in the die hole 61 without space therebetween (see, FIG. 7).

In the forming stage S2 described above, the punch pin 65 is pushed into the die hole 61 by die closing to push the material 1 inserted in the die hole 61. Thus, a first end of the material 1 is extruded in an axial direction (the right direction in FIG. 7) and deformed to fill the shaft hole 63 (see, FIG. 8). The material 1 is thus extended in the axial direction, providing the shaft portion 3 at the first end of the material 1 (right end in FIG. 7), which has a smaller diameter than that of the outline of the material 1 (see, FIG. 8). The process performed at this second forming stage S2 corresponds to "forming a shaft portion on a first end of the material" according to the aspect of the invention.

After the forming stage S2 is completed, the material 1 is ejected from the die hole 61 by a knock out pin 67, and then held by the holder 145R that is standing by at an entrance of the die hole 61. The material 1 is then transported by the transporter 140 to the subsequent forming stage S3.

During the transportation from the second forming stage S2 to the third forming stage S3, the material 1 is inverted by 180 degrees by the rotation of the holder 145R. Then, the material 1 is inserted into a die hole 81 in the third forming stage S3 (described in the following description) with a non-formed second end thereof (an end opposite to the shaft portion 3) ahead. The inversion of the material 1 by the rotation of the holder 145R during the transportation between the second and third forming stages corresponds to "inverting an orientation of the material" according to the aspect of the invention.

<Third and Fourth Forming Stages>

Figure 9:
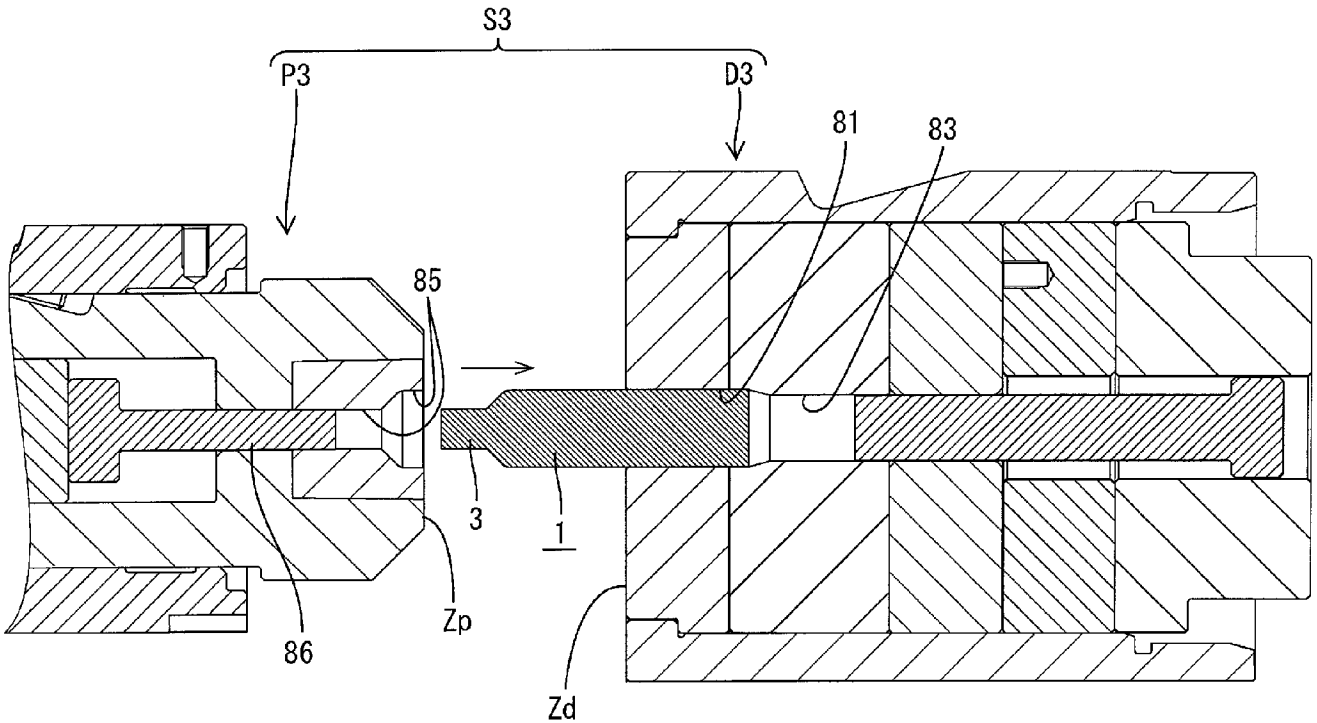
FIG. 9 is a lateral cross sectional view illustrating a punch and a die in a forming stage S3 in the die opening state.
Figure 11:
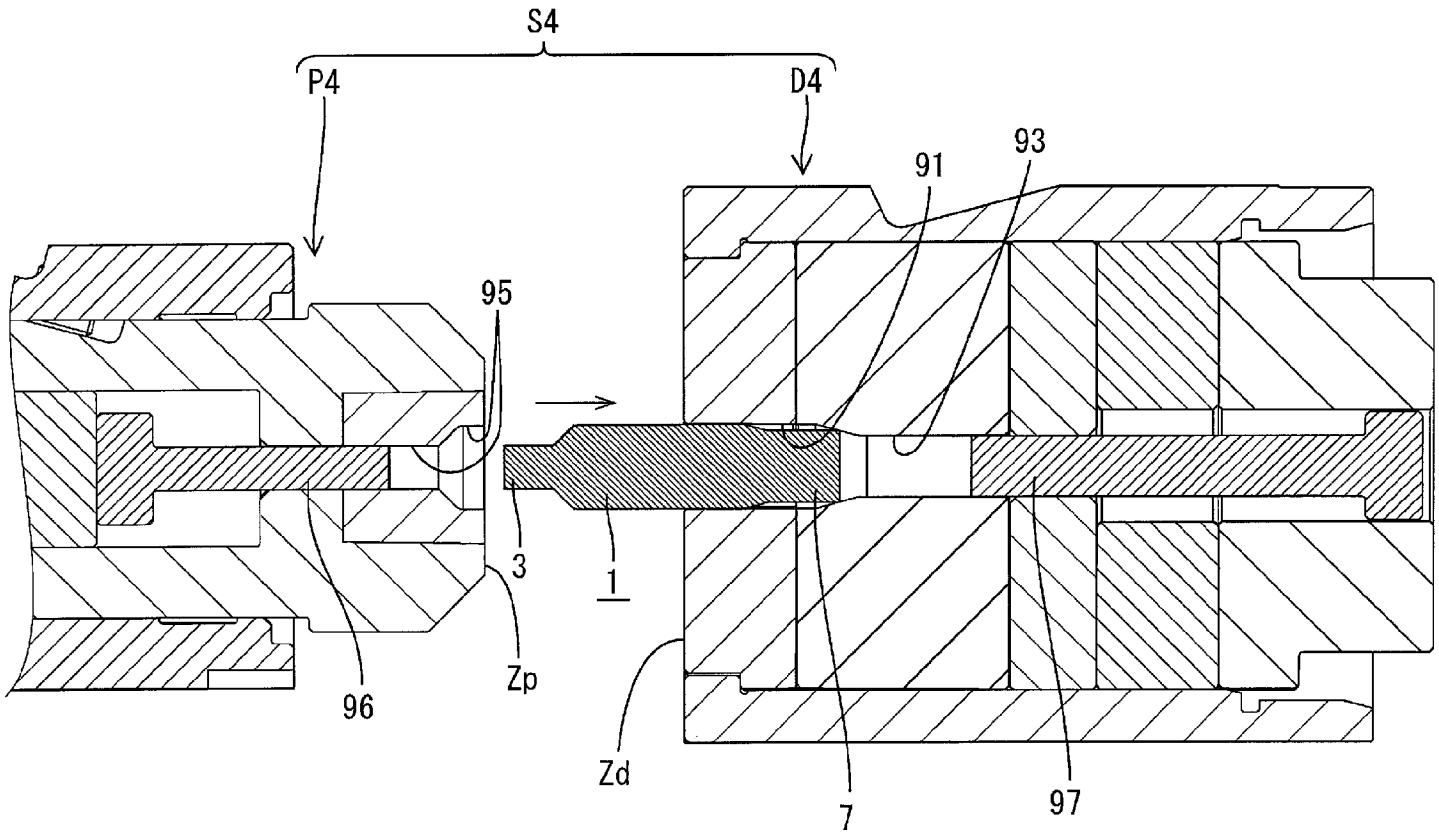
FIG. 11 is a lateral cross sectional view illustrating a punch and a die in a forming stage S4 in the die opening state.

The third and fourth dies D3 and D4 respectively in the third and fourth forming stages S3 and S4, which are cylindrical dies of metal, respectively have die holes 81 and 91 in their respective forming surfaces Zd (see, FIGS. 9 and 11). The die holes 81 and 91 are sufficiently sized to accept the material 1. The depths of the die holes 81 and 91 are shorter than the entire length of the material 1. Therefore, when the material 1 is inserted in the die hole 81 or 91, the end of the material 1 including the shaft portion 3 protrudes from the forming surface Zd of the die D3 or D4. The third and fourth dies D3 and D4 respectively have shaft holes 83 and 93 further inside than the die holes 81 and 91. The shaft holes 83 and 93 have a diameter smaller than those of the die holes 81 and 91 to form the shaft portion 7 at an end of the material 1.

The third punch P3 and the fourth punch P4 as paired respectively with the third die D3 and fourth die D4, which are cylindrical punches of metal, respectively have punch holes 85 and 95 in their respective forming surfaces Zp. The punch holes 85 and 95 are shaped to conform to the shape of the end of the material 1 (i.e., the shape of the shaft portion 3), and thus adapted to accept the shaft portion 3 protruding from the forming surface Zd of the die D3 or D4. In the punch holes 85 and 95, punch pins 86 and 96 are respectively attached. The punch pins 86 and 96 are positioned such that, at the time of the die closing, the respective ends of the punch pins 86 and 96 abut on the end of the shaft portion 3 inserted in each of the punch holes 85 and 95.

Figure 10:
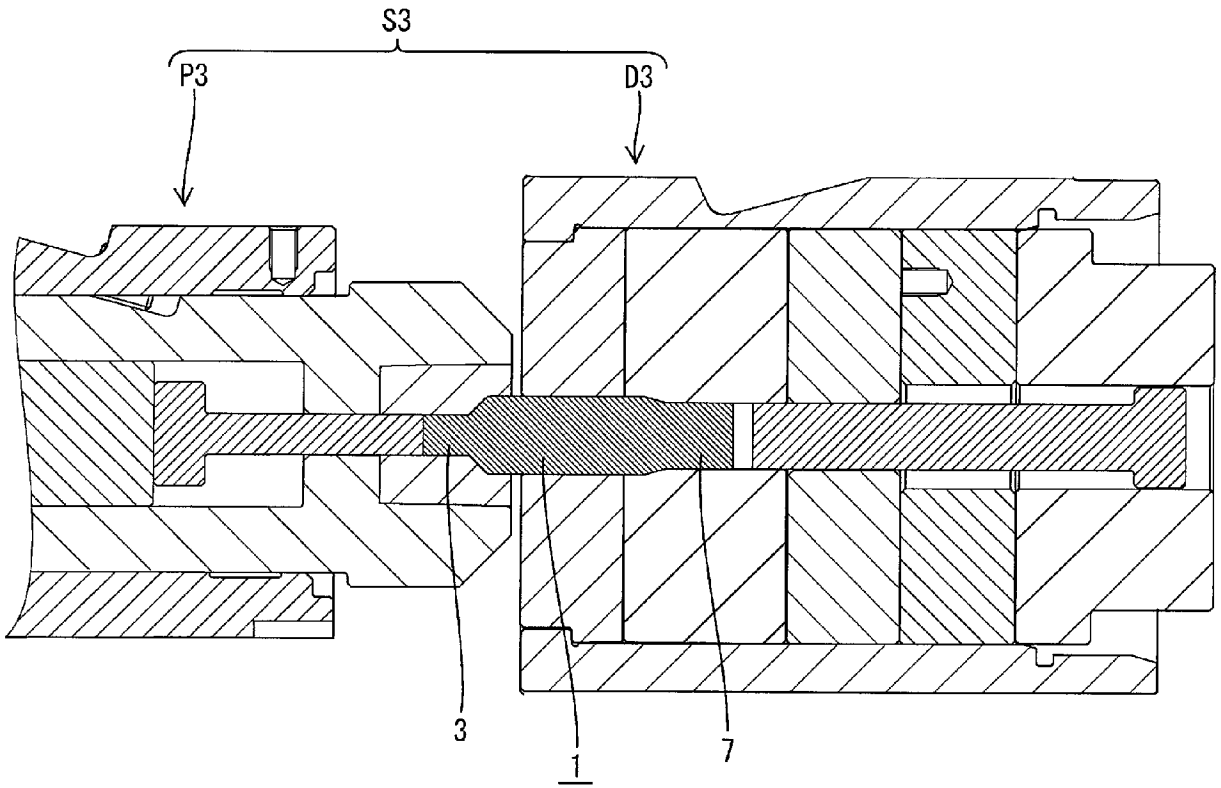
FIG. 10 is a lateral cross sectional view illustrating the punch and the die in the forming stage S3 in the die closing state.
Figure 12:
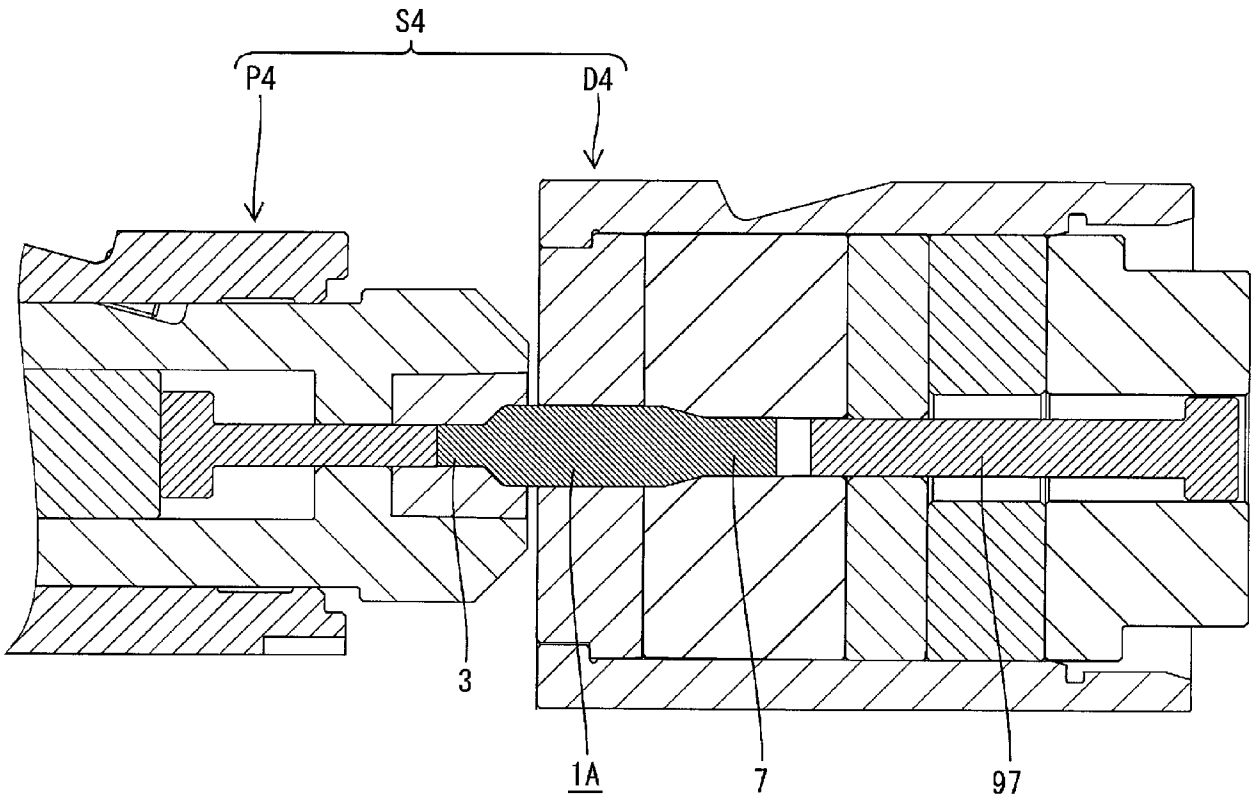
FIG. 12 is a lateral cross sectional view illustrating the punch and the die in the forming stage S4 in the die closing state.

In the forming stages S3 and S4 described above, by the die closing, the punches P3 and P4 push the materials 1 mounted in the die holes 81 and 91 toward the further inside of the die holes 81 and 91. Thus, the second end of the material 1 (right end in FIGS. 9 and 11) is extruded in the axial direction (the right direction in FIGs. 9 and 11), such that the second end of the material 1 is deformed to fill the shaft holes 83 and 93 (FIGS. 10 and 12).

For the shaft holes 83 and 93 of the dies D3 and D4, the diameter thereof become smaller, as the stage proceeds. Through the two processes, the material 1 is extended in the axial direction in a stepwise manner, thereby the shaft portion 7 is formed at the second end of the material 1. Thus, the shafts 3 and 7 are respectively formed at the respective ends of the material 1 (see, FIG. 12). In this manner, the primary product 1A is formed. Thereafter, the primary product 1A is ejected from the die hole 91 by a knock out pin 97, and held by the holder 145 that is standing by at an entrance of the die hole 91. The primary product 1A is then transported by the transporter 140 to the subsequent forming stage S5. The processes performed at these third and fourth forming stages S3 and S4 correspond to "forming a shaft portion on a second end of the material" according to the aspect of the invention.

<Fifth Forming Stage>

Figure 13:
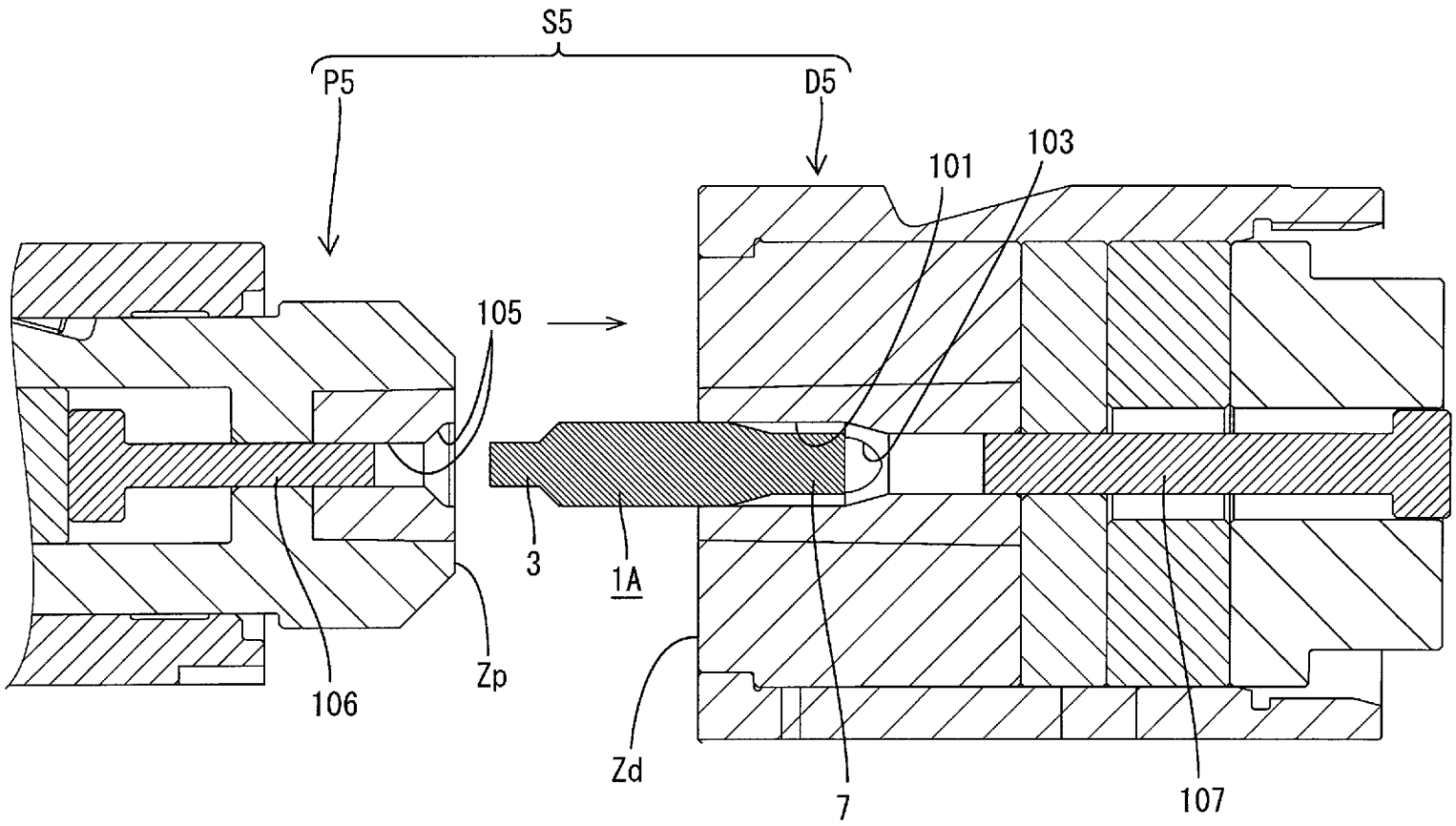
FIG. 13 is a lateral cross sectional view illustrating a punch and a die in a forming stage S5 in the die opening state.

The fifth die D5 in the fifth forming stage S5, which is a cylindrical die of metal, has a die hole 101 in a forming surface Zd (a surface facing the fifth punch P5) (see, FIG. 13). The die hole 101 is sufficiently sized to accept the primary product 1A. A middle portion of the die hole 101 has a flat surface forming portion 103.

The fifth punch P5 as paired with the fifth die D5 is made of metal to have a cylindrical shape, like the fifth die D5. A forming surface Zp (a surface facing the fifth die D5) of the fifth punch P5 has a punch hole 105. The punch hole 105 is shaped to conform to the shape of the end of the primary product 1A (i.e., the shape of the shaft portion 3), and thus adapted to accept the shaft portion 3 protruding from the forming surface Zd of the die D5. In the punch hole 105, a punch pin 106 is attached. At the time of the die closing, an end of the punch pin 106 abuts on the end of the shaft portion 3 inserted in the punch hole 105.

Figure 14:
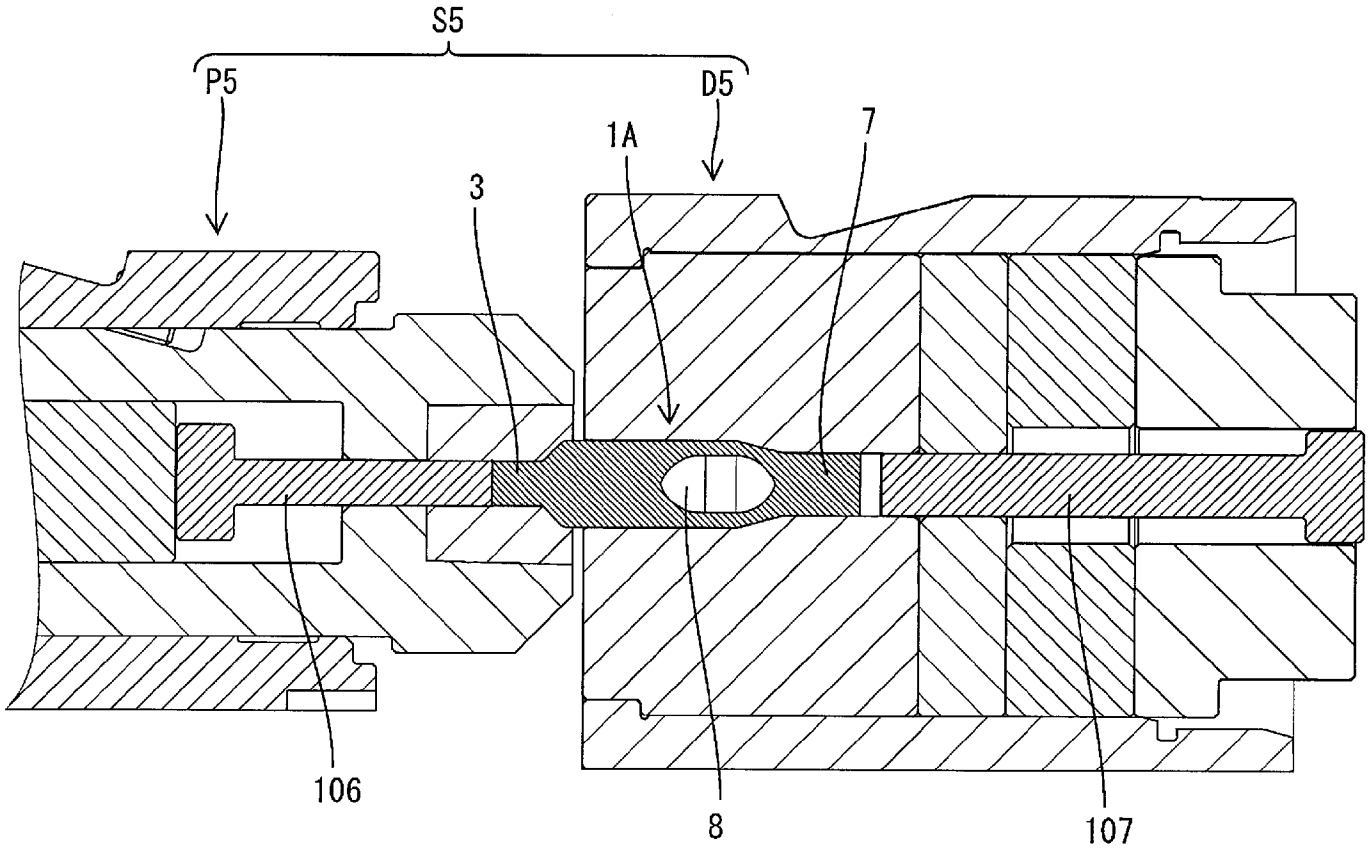
FIG. 14 is a lateral cross sectional view illustrating the punch and the die in the forming stage S5 in the die closing state.

In the forming stage S5 described above, by the die closing, the punch P5 pushes the primary product 1A mounted in the die hole 101 toward the further inside of the die hole 101. Thus, the primary product 1A is deformed within the die hole 101 to have a flat surface 8 on an outer circumference of the primary product 1A (see, FIG. 14). Then, the primary product 1A is ejected from the die hole 101 by a knock out pin 107, and held by the holder 145 that is standing by at an entrance of the die hole 101. The primary product 1A is then transported by the transporter 140 to the subsequent forming stage S6. FIG. 14 illustrates the flat surface 8 in white in contrast to the colored background.

2. Step B: Forming of Secondary Product 1B

Step B includes two processes performed respectively at the two forming stages S6 and S7.

Figure 15:
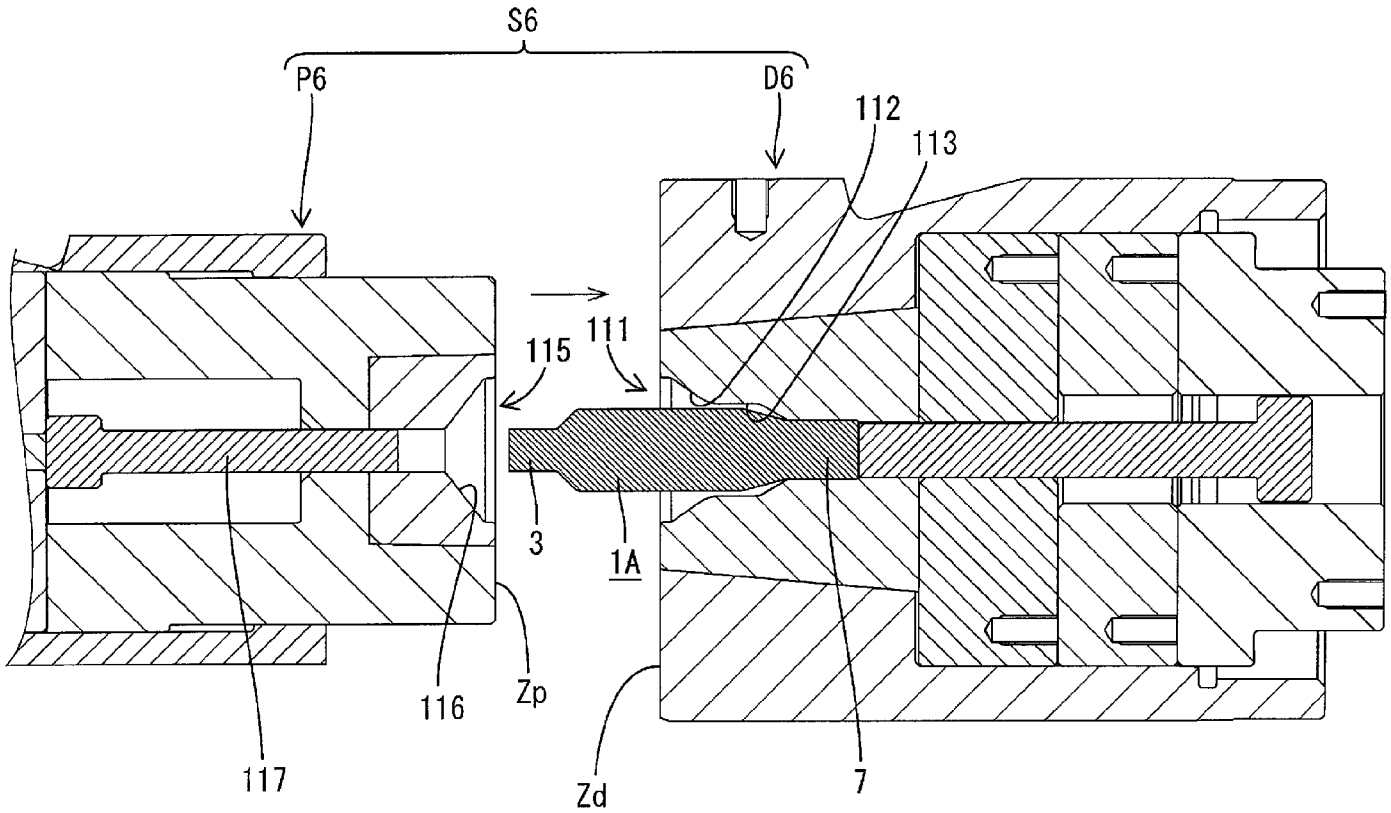
FIG. 15 is a lateral cross sectional view illustrating a punch and a die in a forming stage S6 in the die opening state.
Figure 16:
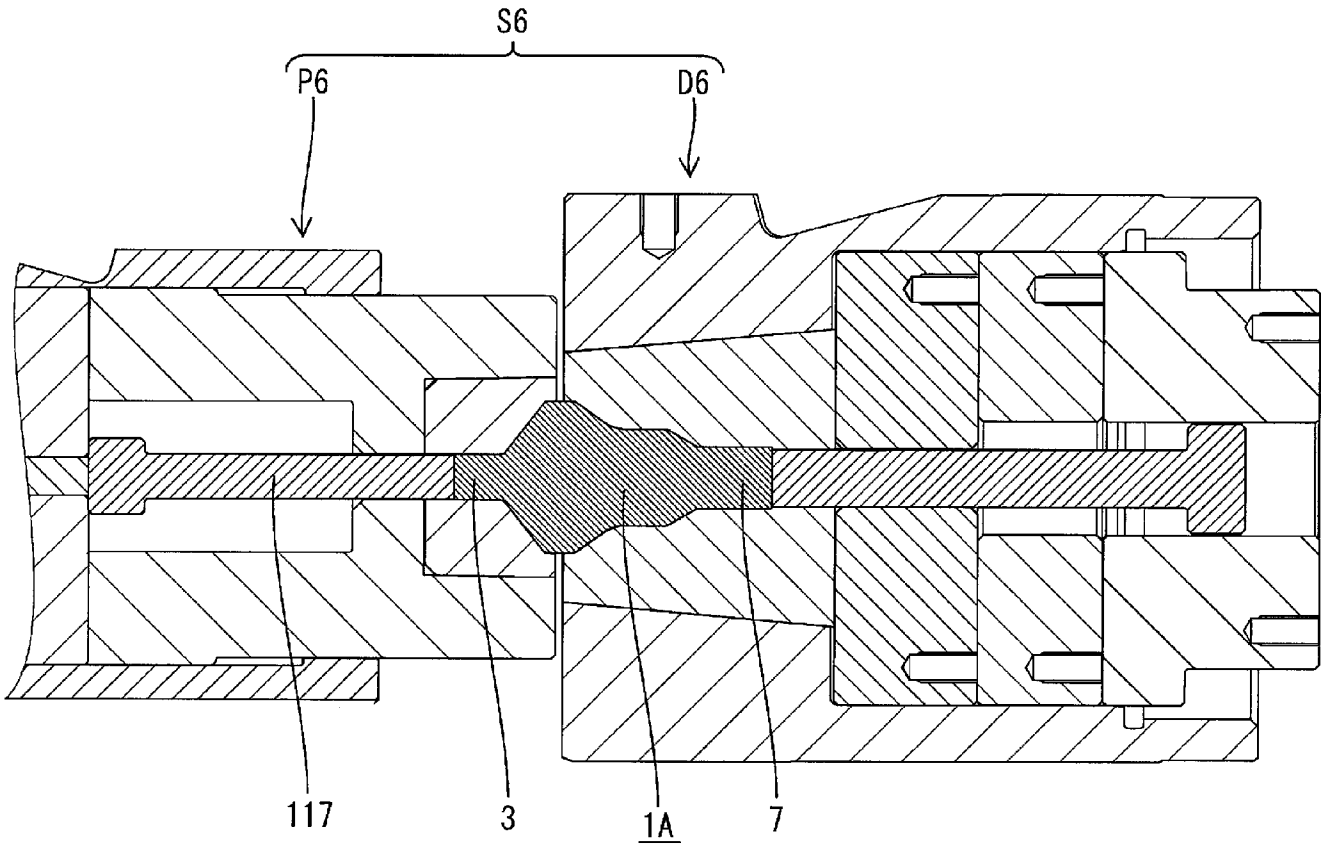
FIG. 16 is a lateral cross sectional view illustrating the punch and the die in the forming stage S6 in the die closing state.

The sixth die D6 in the forming stage S6, which is a cylindrical die of metal, has a die hole 111 in a forming surface Zd (see, FIG. 15). The die hole 111 is sufficiently sized to accept the primary product 1A. The depth of the die hole 111 is shorter than the entire length of the primary product 1A to accommodate substantially a right half of the primary product 1A. An entrance of the die hole 111 has a die-side widened hole 112, which increases its opening toward the entrance. A middle portion of the die hole 111 has a forming hole 113, which have a larger diameter than the outline of the primary product 1A. The forming hole 113 serves to form a stepped portion 13 on a middle portion (axially middle portion) of the primary product 1A.

The sixth punch P6 as paired with the sixth die D6, which is a cylindrical punch of metal, has a punch hole 115 in a forming surface Zp (see, FIG. 15). An entrance of the punch hole 115 has a punch-side widened hole 116. Like the die-side widened hole 112, the punch-side widened hole 116 increases its opening toward the entrance. The punch-side widened hole 116 is paired with the die-side widened hole 112 to form the first overhang 15 that extends outward from the middle portion (axially middle portion) of the primary product 1A. In the punch hole 115, a punch pin 117 is attached. At the time of the die closing, an end of the punch pin 117 abuts on the end of the shaft portion 3 inserted in the punch hole 115.

In the forming stage S6 described above, by the die closing, the punch P6 pushes the primary product 1A mounted in the die hole 111 toward the further inside of the die hole 111. Pressed by the punch P6, the primary product 1A is squeezed to reduce its entire length and deformed to fill both the widened holes 112 and 116 and the forming hole 113 with its middle portion (see, FIG. 16).

Figure 17:
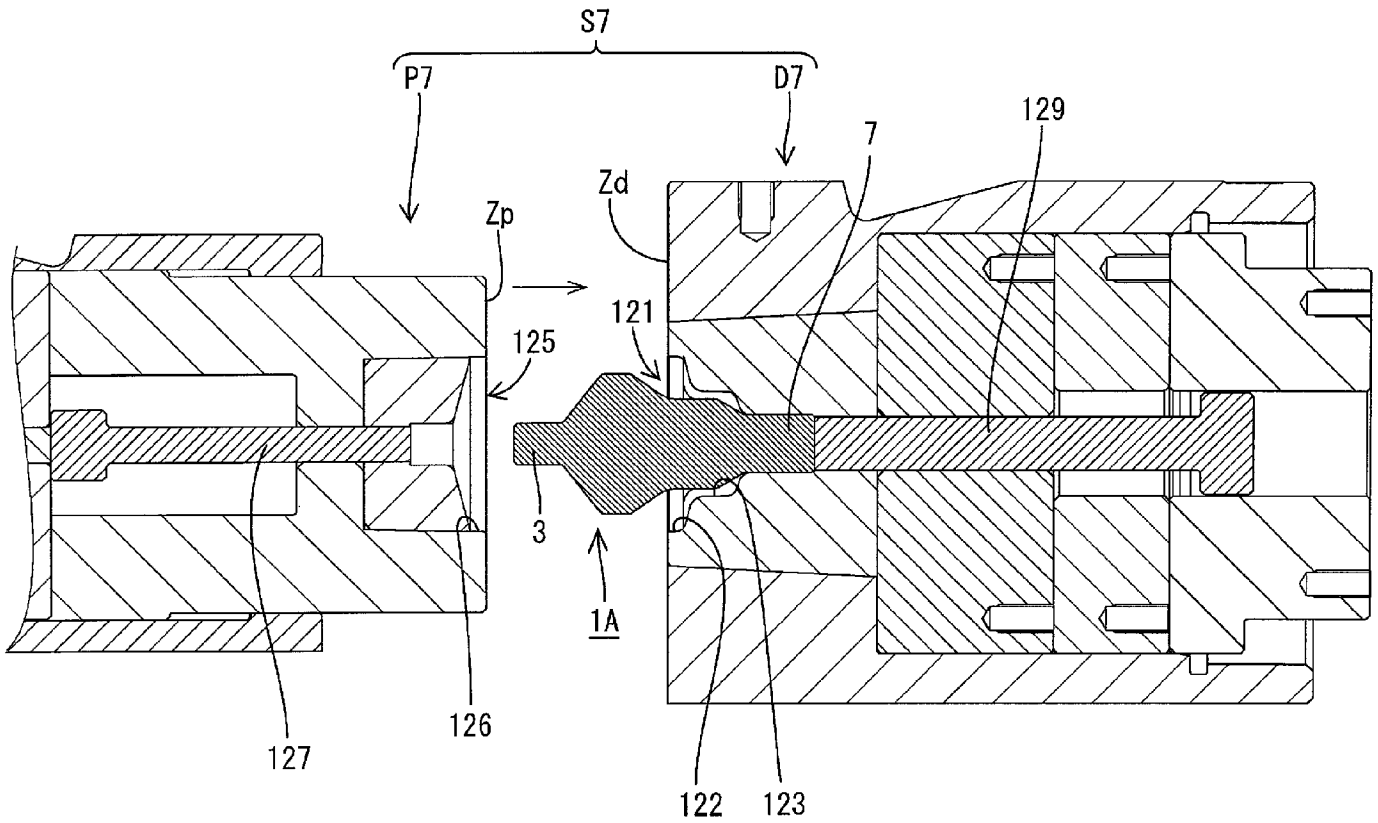
FIG. 17 is a lateral cross sectional view illustrating a punch and a die in a forming stage S7 in the die opening state.
Figure 18:
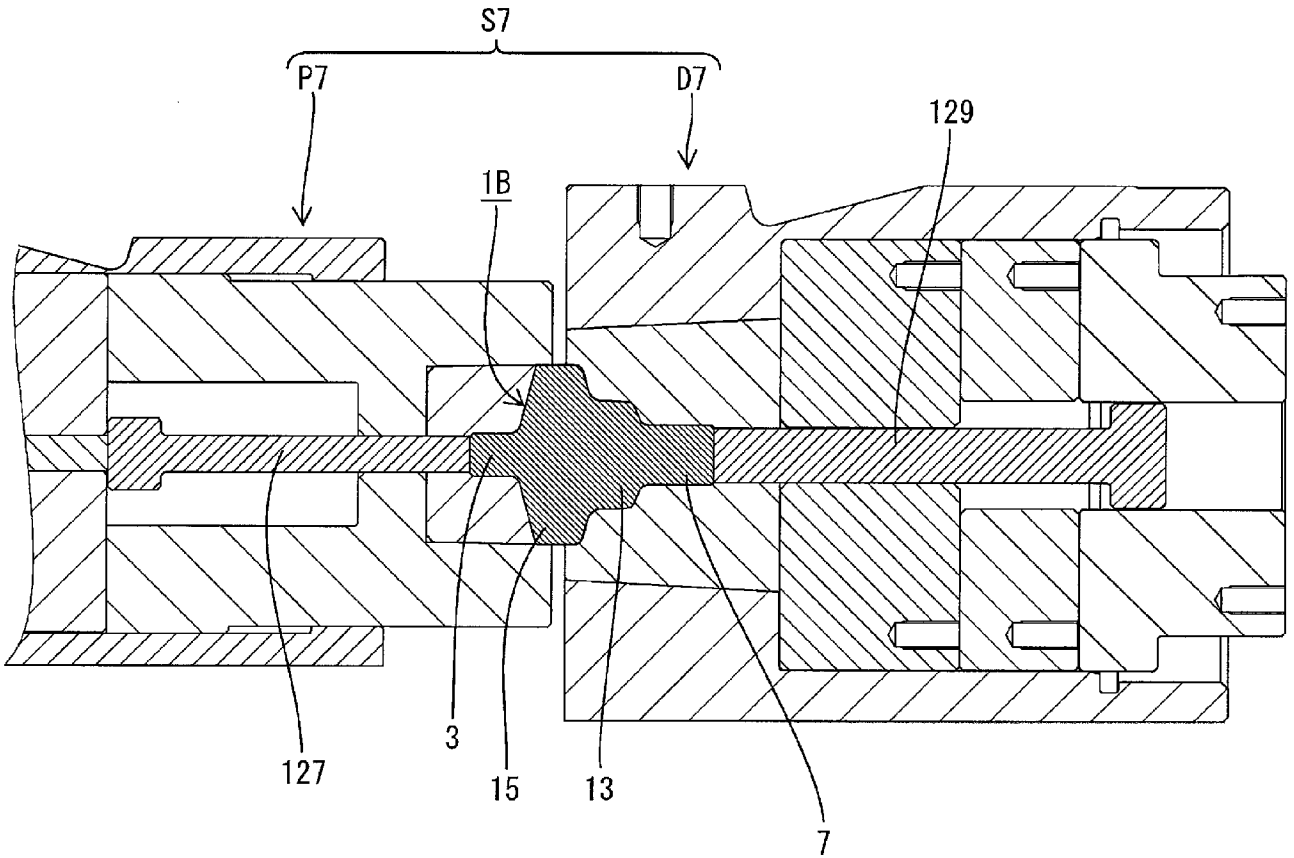
FIG. 18 is a lateral cross sectional view illustrating the punch and the die in the forming stage S7 in the die closing state.

The seventh die D7 in the forming stage S7, which is a cylindrical die of metal, has a die hole 121 in a forming surface Zd (see, FIG. 17). The die hole 121 is sufficiently sized to accept the primary product 1A. The depth of the die hole 121 is shorter than the entire length of the primary product 1A to accommodate substantially a right half of the primary product 1A. An entrance of the die hole 121 has a die-side widened hole 122. A middle portion of the die hole 121 has a forming hole 123, which has a larger diameter than the outline of the primary product 1A. The forming hole 123 serves to form a stepped portion 13 on an outer circumference of the primary product 1A.

The seventh punch P7 as paired with the seventh die D7, which is a cylindrical punch of metal, has a punch hole 125 in a forming surface Zp (see, FIG. 17). An entrance of the punch hole 125 has a punch widened hole 126. The punch-side widened hole 126 is paired with the die-side widened hole 122 to form the first overhang 15 that extends outward from the middle portion of the primary product 1A. In the punch hole 125, a punch pin 127 is attached. At the time of the die closing, an end of the punch pin 127 abuts on the end of the shaft portion 3 inserted in the punch hole 125.

In the forming stage S7 described above, by the die closing, the punch P7 pushes the primary product 1A mounted in the die hole 121 toward the further inside of the die hole 121. Pushed by the punch P7, the primary product 1A is squeezed to reduce its entire length and deformed to fill both the widened holes 122 and 126 and the forming hole 123 with its middle portion (see, FIG. 18).

The widened holes are shaped to become thinner but wider in a stepwise manner, as the stage progresses. Through the two processes, the first overhang 15 that extends outward in the radial direction from the middle portion of the primary product 1A is formed. The "extends outward in the radial direction" means "overhangs outward in the radial direction". Likewise, the forming holes are shaped to become thinner but greater in a stepwise manner, as the stage progresses. Through the two processes, the stepped portion 13 is formed at the middle portion of the primary product 1A. In the manner described above, the secondary product 1B is formed from the primary product 1A (see, FIG. 18).

Like the targeted shape of the flange 35 of the anchor block 1D, the first overhang 15 has a substantially elliptic shape that extends outward in the radial direction when seen from the axial direction. The overhung lengths of the first overhang 15 respectively in the longer-side direction and the shorter-side direction of the elliptic shape are smaller than those of the flange 35, while a thickness t of the first overhang 15 is greater than the flange 35 (see, FIG. 1).

The formed secondary product 1B is ejected from the die hole 121 by a knock out pin 129. The ejected secondary product 1B is subjected to processes such as descaling and surface processing, and then transported to a single-stage forging die device 200.

3. Step C: Forming of Tertiary Product 1C

Step C includes a single process performed with use of the single-stage forging die device 200 described below.

Figure 19:
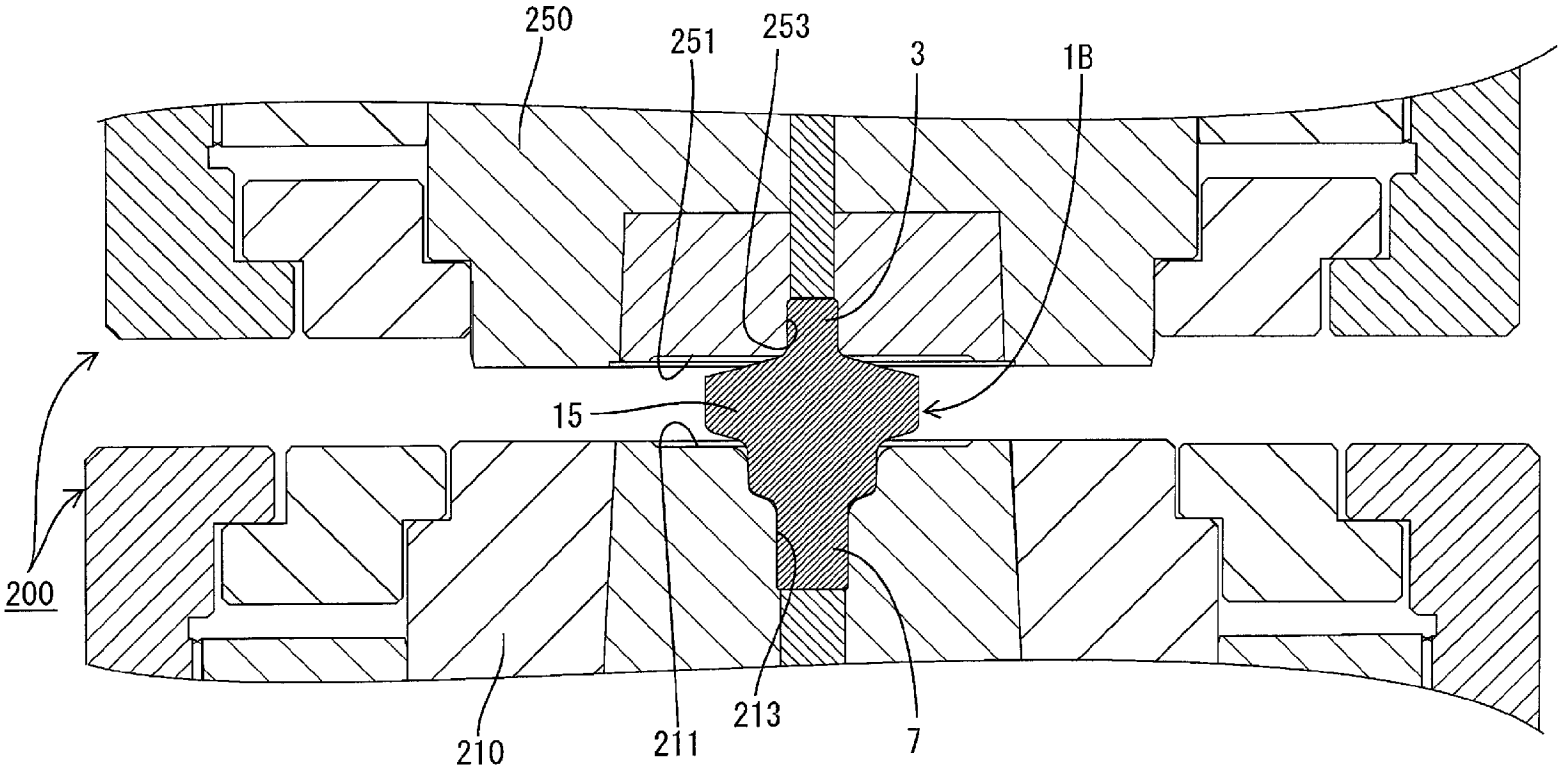
FIG. 19 is a lateral cross sectional view illustrating a single-stage forging die device in the die opening state.
Figure 20:
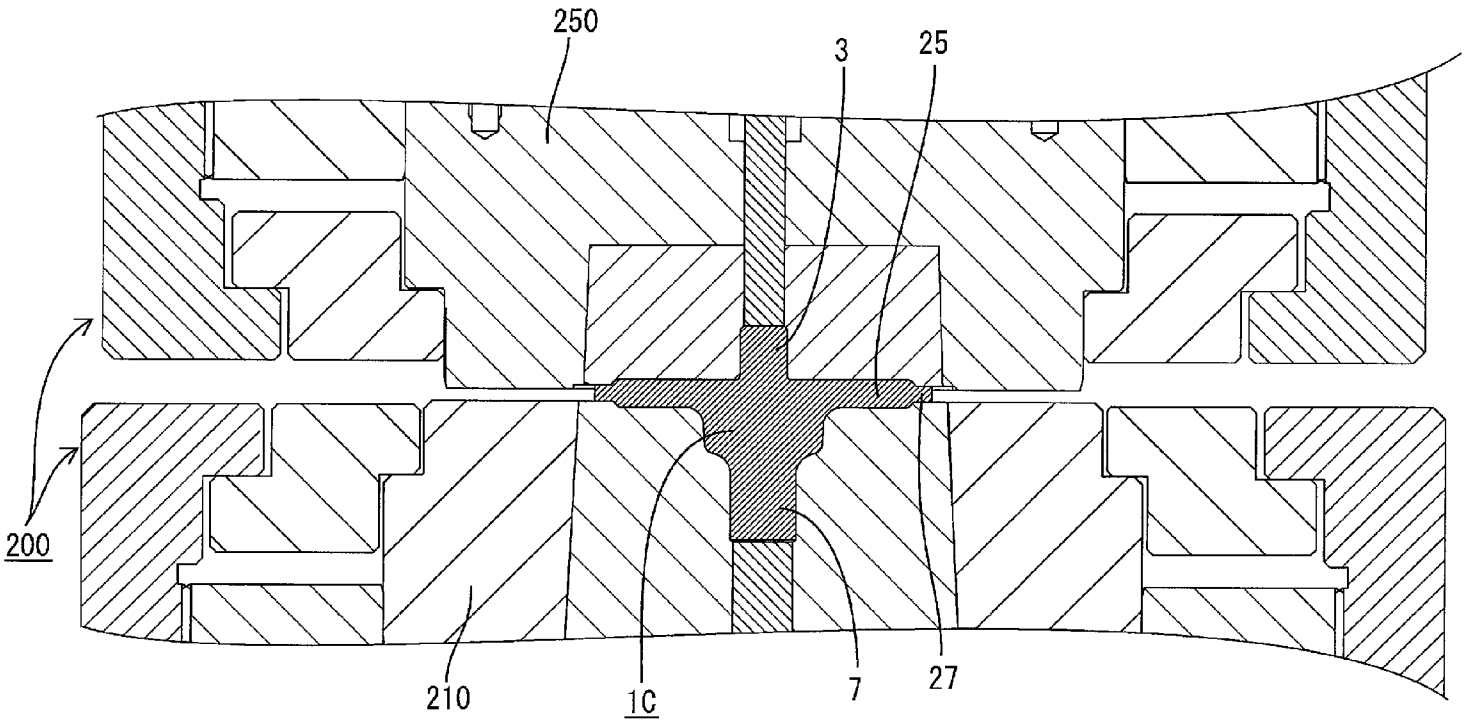
FIG. 20 is a lateral cross sectional view illustrating the single-stage forging die device in the die closing state.

As illustrated in FIG. 19, the single-stage forging die device 200 includes a die 210 and a punch 250. The die 210, which is a cylindrical die of a metal, has a die-side recess 211 on its top surface (surface facing the punch 250). The outline of the die-side recess 211 seen from the upper direction is configured to conform to the outline of the flange 35 of the anchor block 1D seen from the axial direction. In addition, the die-side recess 211 has a shaft hole 213 vertically in the center of the bottom surface of the die-side recess 211 to accept the shaft portion 7 of the secondary product 1B. The secondary product 1B is mounted on the dies 210 by inserting the shaft portion 7 in the shaft hole 213.

On the other hand, the punch 250, which is a cylindrical punch made of metal, is movable in the upper and lower direction. A lower surface of the punch 250 (surface facing the die 210) has a punch recess 251. The outline of the punch recess 251 seen from the lower direction is configured to conform to the outline of the flange 35 of the anchor block 1D seen from the axial direction. In addition, the punch recess 251 has a shaft hole 253 vertically in the center of the top surface of the punch recess 251 to accept the shaft portion 3 of the secondary product 1B. The punch 250 is fixed to a pressure device (not illustrated). The sum of both depths of the die-side recess 211 and the punch recess 251 is set to be smaller than the targeted thickness of the flange 35.

The single-stage forging die device 200 performs the die closing by operating the pressure device to move the punch 250 downward. By the die closing, the first overhang 15 of the secondary product 1B mounted on the die 210 is squeezed between the die 210 and the punch 250 to extend in the planar direction, and, as a result, the second overhang 25 is formed (see, FIG. 20).

The downward movement of the punch 250 is continued until the punch 250 reaches at a position where a distance between the bottom surface of the die-side recess 211 and the top surface of the punch recess 251 becomes substantially equal to the targeted thickness of the flange 35.

On the other hand, the sum of both depths of the die-side recess 211 and the punch recess 251 is smaller than the thickness of the flange 35. Thus, when the forming is performed with the die closing, upper and lower surfaces and apart of an outer circumference (lateral surface) of the first overhang 15 which extend between the die 210 and the punch 250 are constrained by the die-side recess 211 and the punch recess 251, but most of the outer circumference thereof is not constrained.

Accordingly, a part of the first overhang 15 is forced out from between the die-side recess 211 and the punch 251, and freely flows outward (in the planar direction). As described above, apart of the outer circumference of the first overhang 15 is free from the constraint by the die, and an excessive material is forced outward from between the punch 250 and the die 210 as an excessive portion (hereinafter referred to as excessive portion 27). Thus, the forging is performed without an excessive forming pressure. The tertiary product 1C with the second overhang 25 is obtained in this manner. The thickness of the second overhang 25 is equal to the targeted one of the flange 35 of the anchor block 1D. In addition, seen from the axial direction, the outline of the second overhang 25 is substantially an elliptic shape greater than the outline (profile) of the flange 35 of the anchor block 1D by the excessive portion 27 overhanging outward.

4. Step D: Forming of Flange 35

The obtained tertiary product 1C is subjected to a punching process described below. In this punching process, the excessive portion 27 is cut off from the second overhang 25 to form the profile of the flange 35. Preferably, the punching process is performed soon after the tertiary product 1C is obtained. After the elapse of time, work hardening progresses, which is likely to cause the final product to be cracked at time of punching.

Figure 21:
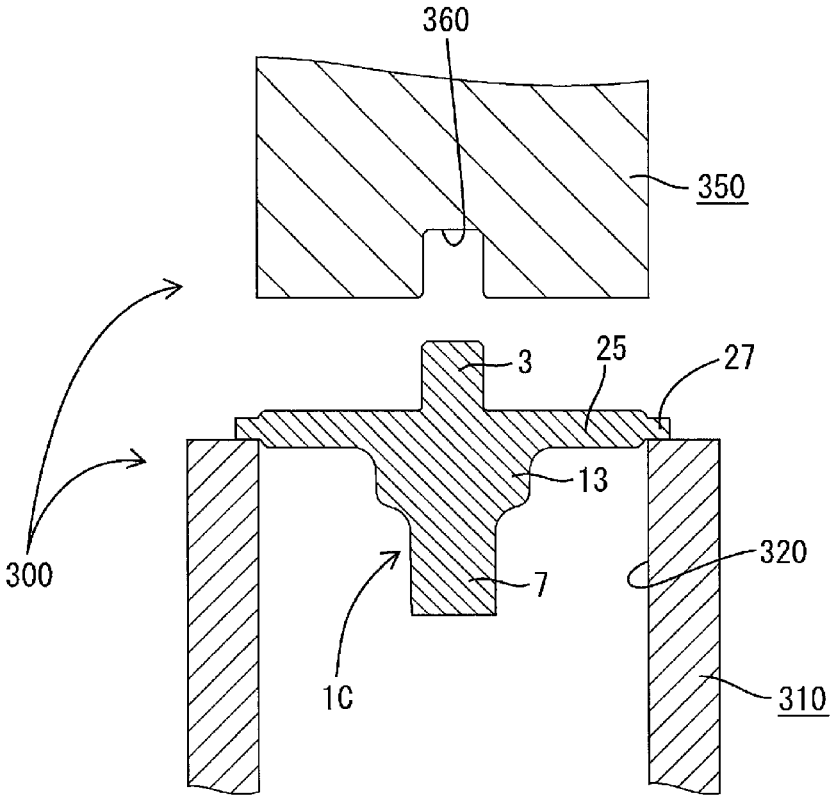
FIG. 21 is a lateral cross sectional view illustrating a punching device.
Figure 22:
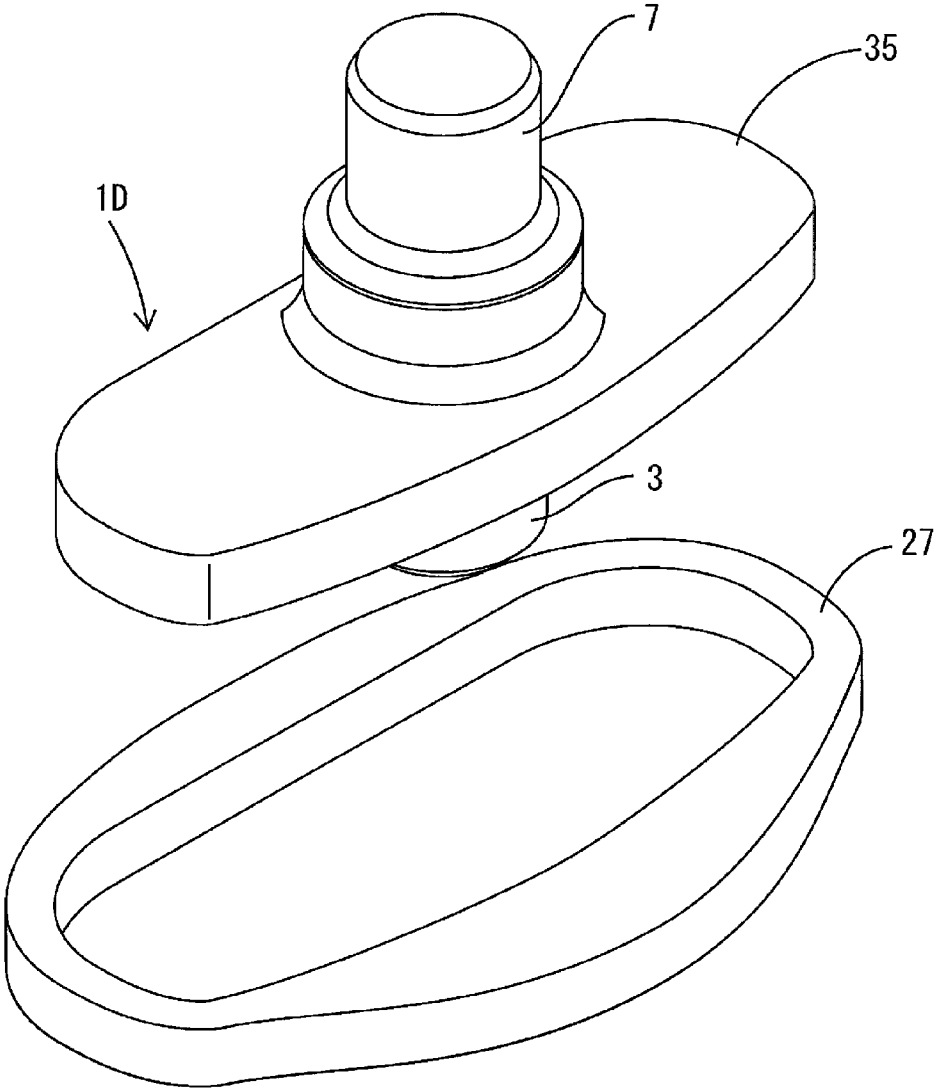
FIG. 22 is a perspective view illustrating the anchor block and an excessive portion cut off from the anchor block.

As illustrated in FIG. 21, a punching device 300 for use in the punching process includes a punching die 310 and a punching punch 350. The punching die 310, which is made of metal, has a punching hole 320 vertically through the middle portion of the punching die 310. The outline of the punch hole 320 seen from the vertical direction (thickness direction) is configured to conform to the outline of the flange 35 of the anchor block 1D seen from the axial direction. On the other hand, the punching punch 350, which is made of metal, is adapted to be inserted into the punching hole 320 in substantially an airtight manner. The punching punch 350 has a receiving hole 360 vertically in a lower surface of the punching punch 350 to accept the shaft portion 3 of the tertiary product 1C. The punch 350 is fixed to a pressure device (not illustrated).

In the punching process with use of the punching device 300 described above, first of all, the tertiary product 1C is mounted on the punching hole 320 with the shaft portion 7 downward. Specifically, the excessive portion 27 is mounted on an edge of the punching hole 320, and the second overhang 25 (except for the excessive portion 27) is fitted in the inner circumference of the punching hole 320. Subsequently, the punching punch 350 is moved downward by operating the pressure device. Thus, the portion of the second overhang 25 located inward than the edge of the punching hole 320 is punched. Then, the punched product drops downward through the punching hole 320, and the excessive portion 27 remains on the punching die 310. In this manner, the excessive portion 27 is cut off from the second overhang 25, and the profile of the flange 35 is obtained. In the manner described above, the dual-shaft anchor block 1D with the shafts 3 and 7 at both sides of the flange 35 is obtained.

As described above, in the method of manufacturing the flange structure according to the present exemplary embodiment, in the step B, the first overhang 15 with greater thickness than that of the flange 35 is formed at the middle portion of the primary product 1A, and in the step C, the first overhang 15 is further squeezed to form the second overhang 25 that is one size greater than the flange 35 in the outer circumferential direction.

Accordingly, since the second overhang 25 is formed through the two processes, the obtained second overhang 25 exhibits a profile close to the final profile of the flange 35. Therefore, the excessive portion 27 to be cut off is small, which contributes to an improved material yield. In addition, in the step B, the first overhang 15 with thickness greater than that of the flange 35 is formed at the middle portion of the primary product 1A, and in the step C, when the first overhang 15 is squeezed, the excessive material is forced out from between the punch 250 and the die 210 as the excessive portion without constraining a part of the outer circumference (lateral surface) of the first overhang 15. Thus, since a compression load required for the forming in each process is small, the flange 35 with a large overhanging area is obtained without use of hot forging.

Accordingly, both cold forging and warm forging are useful in each step, and thus a large-sized hot-forging device is dispensable. Further, the characteristics of cold or warm forging, such as that products with good surfaces are obtained or that precise working is possible, are fully utilized to reduce additional processes such as cutting and grinding. Therefore, a cost reduction is achieved. Moreover, the increased manufacturing speed is obtained in cold or warm forging, and cold or warm forging does not require much skill and experience with respect to temperature control and the like, compared to the hot forging. Thus, the productivity is enhanced.

According to this exemplary embodiment, the shafts 3 and 7 are respectively formed at the respective ends of the material 1 in the step A. If the shaft portion 7 is formed in the step B or C at the same time as the first overhang 15 or the second overhang 25 is formed, the material 1 is required to be swaged to form the shaft portion 7 while swaged to form the overhang 15 or 25, which would inevitably increase the compression load. Especially in step C, when the second overhang 25 is formed by squeezing the first overhang 15, apart of the outer circumference is free from the constraint by the die to reduce the compression load. Therefore, the forming of the shaft portion 7 at the same time as the forming of the second overhang 25 would be difficult unless the non-constraint is canceled and the compression load is increased. In this respect, according to this exemplary embodiment, the shafts 3 and 7 are respectively formed at the respective ends of the material 1 in the step A, as described above. Thus, there is no need to form the shaft portion 3 or 7 at the same time as the forming of the first overhang 15 or the second overhang 25 in the subsequent step B or C.

Figure 24:
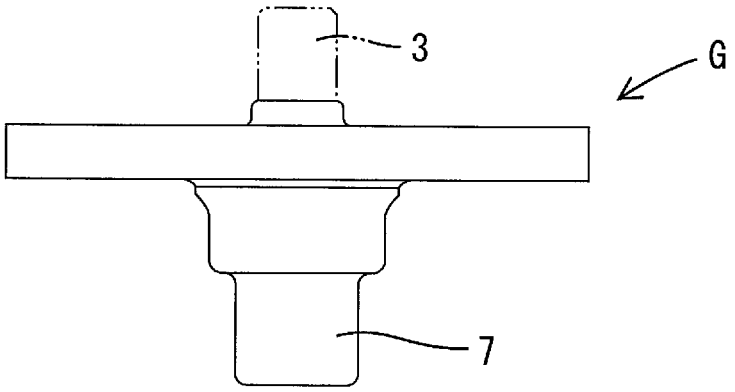
FIG. 24 is a front view illustrating a dual-shaft anchor bolt.
Figure 25:
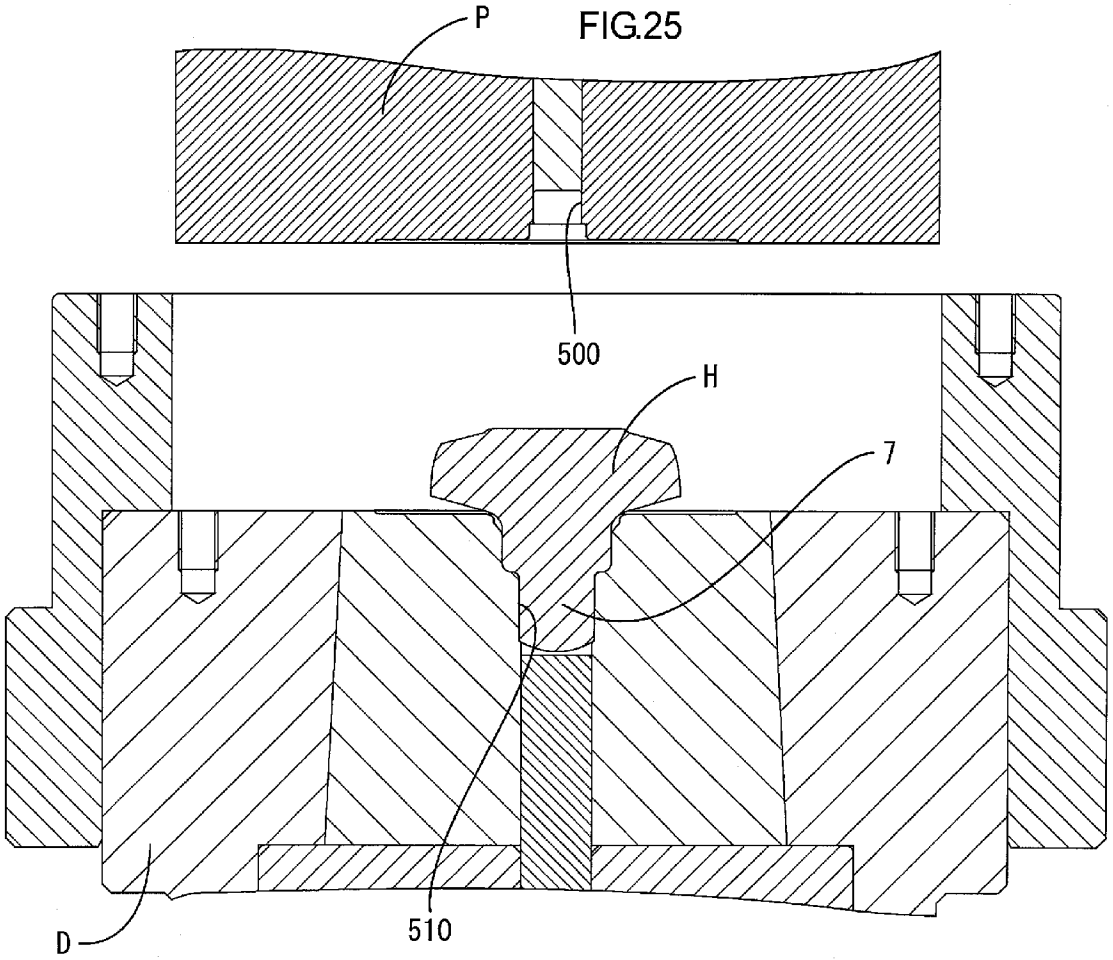
FIG. 25 is a lateral cross sectional view illustrating a punch and a die under an operation of forming a shaft portion in the die opening state.
Figure 26:
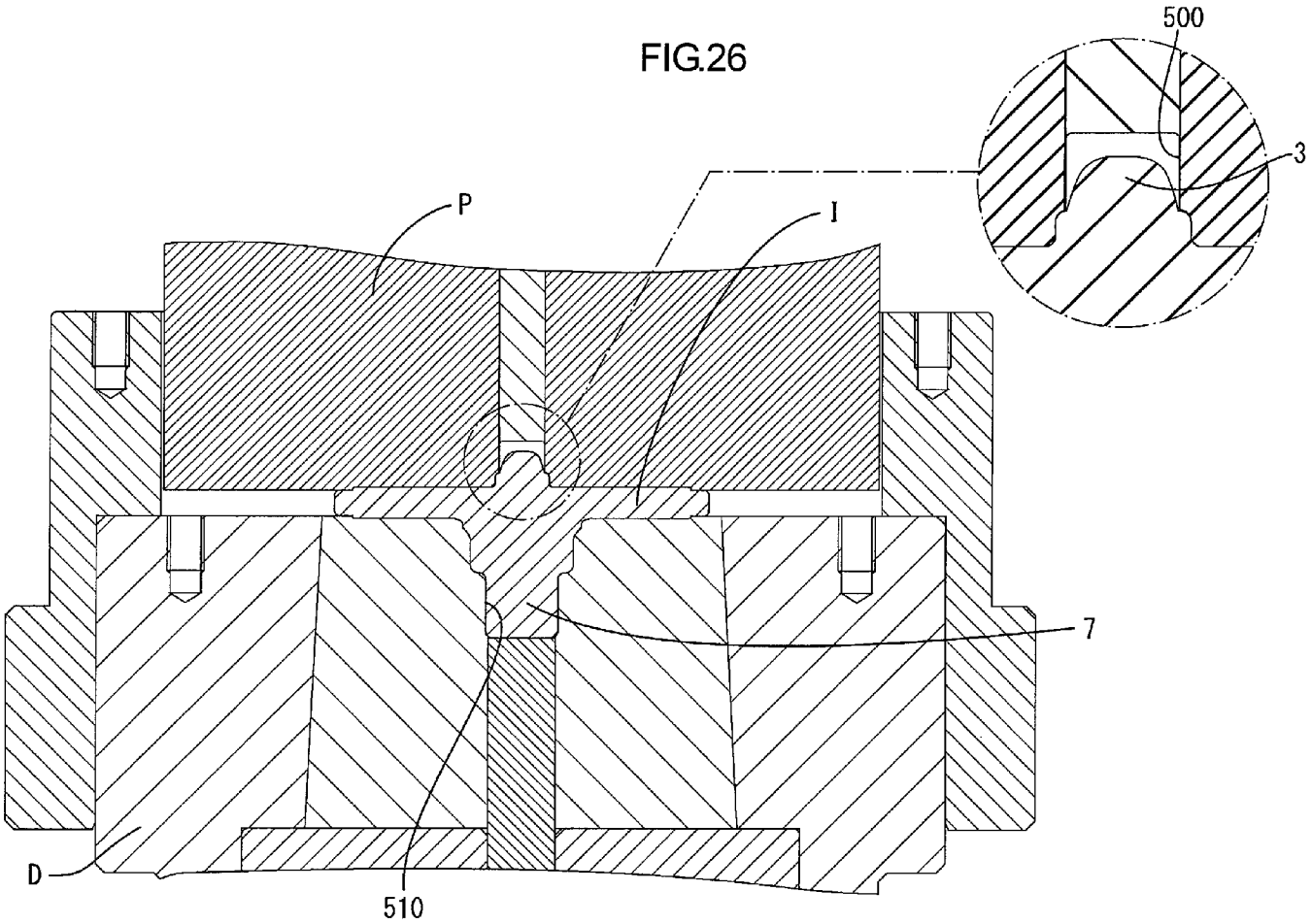
FIG. 26 is a lateral cross sectional view illustrating the punch and the die under the operation of forming the shaft portion in the die closing state.

Accordingly, the compression load required for the forming in the step B or C is suppressed to approximately the same level as that required for the forming a single-shaft anchor block with a shaft portion at a single side (the anchor block represented by solid line in FIG. 24). Thus, for the dual-shaft anchor block 1D with a shaft portion at both sides, cold or warm forging is useful through steps A to C.

According to this exemplary embodiment, the shaft portion 3 on the first side is formed by the die hole 61 of the second forming stage S2. Then, the material 1 is inverted and transported to the third forming stage S3. Like the shaft portion 3 on the first side, the shaft portion 7 on the second side is also formed by the die holes 81 and 91 of the third and fourth forming stages S3 and S4. According to this exemplary embodiment, both the shafts 3 and 7 are formed with use of the die holes 61, 81 and 91 of the dies D in the manner described above. Therefore, as compared with a method through which either one of the shaft portion 3 on the first side and the shaft portion 7 on the second side is formed with use of the die D while the other one is formed with use of the punch P, the number of the processes required for forming the shafts 3 and 7 is reduced.

Figure 23:
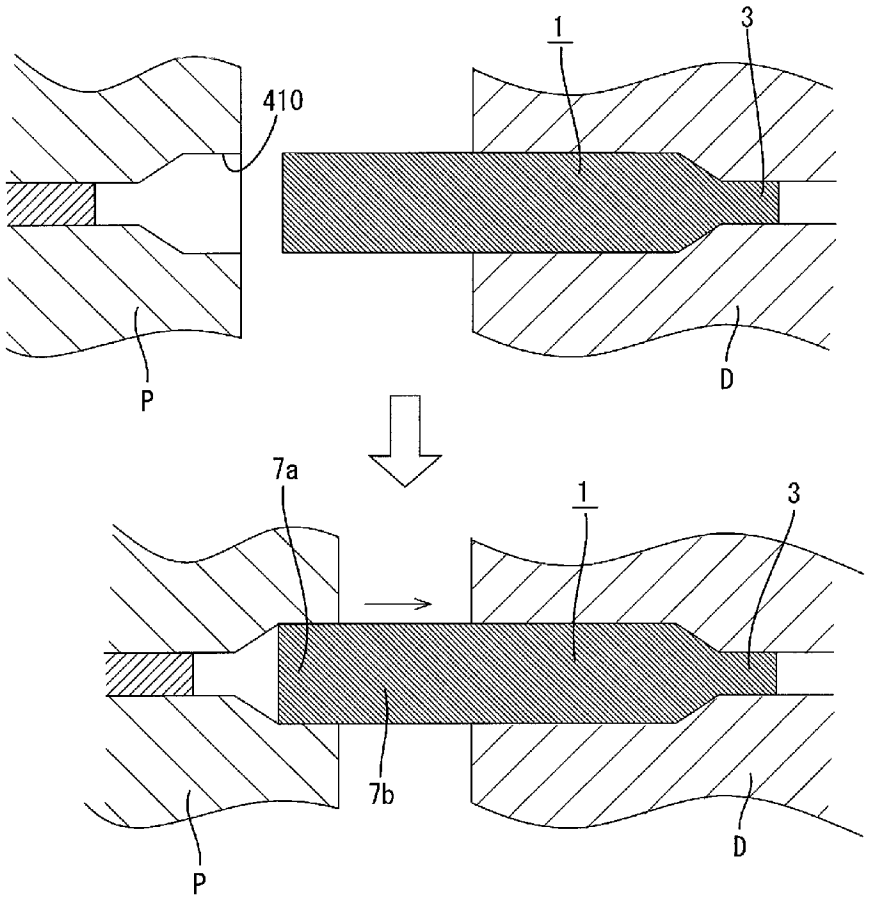
FIG. 23 is a lateral cross sectional view illustrating the die and the punch when the shaft portion is formed by the punch.

The reason therefor is explained as follows. The knocking out amount on the side of the punch P (stroke length for ejecting the formed material) is typically smaller than that on the side of the die D, and the depth of the punch hole 410 is inevitably smaller than those of the die holes 61, 81 and 91. Therefore, if the shaft portion 7 on the second side is formed with use of the punch P after the shaft portion 3 on the first side is formed with use of the die D, as illustrated in FIG. 23, a periphery 7*b* of an end 7*a* of the material 1 to be formed protrudes outside of the punch hole 410. In other words, the shaft portion 7 is inevitably formed with the periphery 7*b* of the end 7*a* free. On the other hand, when the shaft portion 7 is formed with the periphery 7*b* of the end 7*a* free, a limit value for forming the shaft portion 7 without increase in the diameter of the material 1 is a surface reduction rate (a rate of an outer diameter between before and after the forming) of 30% or less.

Accordingly, when the surface reduction rate at the time of forming the shaft portion 7 exceeds the limit value, the shaft portion 7 needs to be formed in a stepwise manner with use of a plurality of forming stages S to keep the surface reduction rate not to exceed the limit value. Therefore, when the stage number of the forming stages S is fixed, the stages for other processes would be required to be spared for the forming of the shaft portion 7. As a result, the number of the forming stages is not sufficient to complete the forming.

In this respect, according to this exemplary embodiment, both the shafts 3 and 7 are formed with use of the die holes 61, 81 and 91 of the dies D. With use of the die holes, which are deeper than the punch holes, the shaft portion 7 is formed with the periphery 7*b* of the end 7*a* constrained, and thus there is no increase in the material diameter (see, FIGS. 9 to 12). Accordingly, even when the surface reduction rate exceeds 30%, the shaft portion 7 is formed through one or two processes (two processes in the present exemplary embodiment). Therefore, in the case of fixed stage number of the forming stages S, the shaft portion 7 requires less number of the forming processes, the forming stages S afford the other processes. Thus, the forming is reliably completed.

<Other Exemplary Embodiments>

The scope of the invention is not limited to the exemplary embodiments described in the above description or illustrated in the drawings. The following exemplary embodiments are included in its technical scope.

While the flange is exemplarily elliptic in the above exemplary embodiment, the flange is not limited to be elliptic but may have another shape such as cross shape or rectangular shape, as long as the shape is not circular. When the flange has a shape other than an ellipse shape, the first overhang of the secondary product is also adapted to conform to the shape of the flange.

The invention claimed is:

1. A method of manufacturing a flange structure including a first shaft portion, a second shaft portion, and a flange provided between the first shaft portion and the second shaft portion, the method comprising:

forming a primary product by extending a columnar material in an axial direction by cold or warm forging such that the first shaft portion is formed at the first axial end of the material and the second shaft portion is formed at a second axial end of the material, the primary product forming step including:

forming the first shaft portion on the first axial end of the material by pushing the material in a first die hole of a first shaft portion die with a first shaft portion punch the first shaft portion die including the first die hole and a first shaft hole that is adapted to form the first shaft portion on the first axial end of the material;

ejecting the material having the first shaft portion from the first die hole of the first shaft portion die with a knock out pin;

inverting an orientation of the material having the first shaft portion ejected from the first die hole of the first shaft portion die; and forming the second shaft portion on the second axial end of the material by pushing the material in a second die hole of a second shaft portion die with a second shaft portion punch, the second shaft portion die including the second die hole and a second shaft hole that is adapted to form the second shaft portion on the second axial end of the material;

forming a secondary product by making a middle portion of the primary product overhang outwardly by cold or warm forging such that a first overhang having a thickness greater than a thickness of the flange is formed;

forming a tertiary product by squeezing the first overhang by cold or warm forging such that a second overhang having an outline greater than an outline of the flange is formed, at least a part of an outer circumference of the first overhang being kept free from a constraint by a tertiary product die and a tertiary product punch while the second overhang is being formed; and defining an outer edge of the flange by cutting off an excessive portion of the second overhang, the excessive portion protruding outwardly from the outline of the flange.

2. The method of manufacturing a flange structure according to claim 1, wherein forming the tertiary product includes forcing at least an outer circumferential part of the first overhang outwardly into a space between the tertiary product die and the tertiary product punch and forming the excessive portion while the second overhang is being formed.

3. The method of manufacturing a flange structure according to claim 2, wherein forming the first shaft portion includes forming the first shaft portion with a diameter smaller than a diameter of the material in the first die hole by pushing the material with the first shaft portion punch to move the material into the first shaft hole such that the first axial end of the material is deformed to become the first shaft portion, and forming the second shaft portion includes forming the second shaft portion with a diameter smaller than a diameter of the material in the second die hole by pushing the material with the second shaft portion punch to move the material into the second shaft hole such that the second axial end of the material is deformed to become the second shaft portion.

4. The method of manufacturing a flange structure according to claim 1, wherein forming the first shaft portion includes forming the first shaft portion with a diameter smaller than a diameter of the material in the first die hole by pushing the material with the first shaft portion punch to move the material into the first shaft hole such that the first axial end of the material is deformed to become the first shaft portion, and forming the second shaft portion includes forming the second shaft portion with a diameter smaller than a diameter of the material in the second die hole by pushing the material with the second shaft portion punch to move the material into the second shaft hole such that the second axial end of the material is deformed to become the second shaft portion.

* * * * *